US009996035B2

(12) United States Patent
Okamoto et al.

(10) Patent No.: US 9,996,035 B2
(45) Date of Patent: Jun. 12, 2018

(54) FIXING DEVICE AND IMAGE FORMING APPARATUS WITH A MOVABLE PRESSER WHICH MOVES A FIXING BELT

(71) Applicants: Masami Okamoto, Kanagawa (JP); Seiji Saitoh, Kanagawa (JP); Keisuke Kubota, Kanagawa (JP); Shuutaroh Yuasa, Kanagawa (JP); Kensuke Yamaji, Kanagawa (JP); Fumihiro Hirose, Kanagawa (JP); Yuuta Kanda, Kanagawa (JP)

(72) Inventors: Masami Okamoto, Kanagawa (JP); Seiji Saitoh, Kanagawa (JP); Keisuke Kubota, Kanagawa (JP); Shuutaroh Yuasa, Kanagawa (JP); Kensuke Yamaji, Kanagawa (JP); Fumihiro Hirose, Kanagawa (JP); Yuuta Kanda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days. days.

(21) Appl. No.: 15/447,666

(22) Filed: Mar. 2, 2017

(65) Prior Publication Data

US 2017/0269525 A1 Sep. 21, 2017

(30) Foreign Application Priority Data

Mar. 18, 2016 (JP) ..... 2016-055924
Apr. 28, 2016 (JP) ..... 2016-090871

(51) Int. Cl.
*G03G 15/20* (2006.01)

(52) U.S. Cl.
CPC ..... *G03G 15/2089* (2013.01); *G03G 15/2017* (2013.01); *G03G 15/2028* (2013.01);
(Continued)

(58) Field of Classification Search
CPC ..... G03G 15/2028; G03G 15/2064; G03G 15/2085; G03G 2215/2022
(Continued)

(56) References Cited

U.S. PATENT DOCUMENTS 8,369,730 B2 * 2/2013 Fujimoto ..... G03G 15/2039 399/329
8,897,687 B2 * 11/2014 Ichiki et al. ..... G03G 15/2064 399/329
(Continued)

FOREIGN PATENT DOCUMENTS

JP 03-133871 6/1991
JP 2003-005566 1/2003
(Continued)

*Primary Examiner* — William J Royer
(74) *Attorney, Agent, or Firm* — Oblon, McClelland, Maier & Neustadt, L.L.P.

(57) ABSTRACT

A fixing device includes a fixing belt that is endless and rotatable in a rotation direction and a nip former stretching the fixing belt. A pressure rotator presses against the nip former via the fixing belt to form a fixing nip between the fixing belt and the pressure rotator, through which a recording medium is conveyed. A presser is disposed downstream from an exit of the fixing nip in the rotation direction of the fixing belt. The presser brings the fixing belt into contact with the pressure rotator. A mover is coupled to the presser to move the presser between a contact position where the presser brings the fixing belt into contact with the pressure rotator and an isolation position where the presser isolates the fixing belt from the pressure rotator.

20 Claims, 15 Drawing Sheets

(52) U.S. Cl.
CPC ..... *G03G 2215/0129* (2013.01); *G03G 2215/2032* (2013.01); *G03G 2215/2041* (2013.01)

(58) Field of Classification Search
USPC ..... 399/323, 329
See application file for complete search history.

(56) References Cited

U.S. PATENT DOCUMENTS

| | | | |
|---|---|---|---|
| 2003/0016971 | A1 | 1/2003 | Kikuchi et al. |
| 2011/0164904 | A1 | 7/2011 | Hirose et al. |
| 2011/0217091 | A1 | 9/2011 | Hirose et al. |
| 2011/0222926 | A1 | 9/2011 | Ueno et al. |
| 2012/0014725 | A1 | 1/2012 | Seto et al. |
| 2012/0044516 | A1 | 2/2012 | Hirose et al. |
| 2012/0207523 | A1 | 8/2012 | Ueno et al. |
| 2012/0224893 | A1 | 9/2012 | Yamamoto et al. |
| 2013/0170877 | A1 | 7/2013 | Yoshiura et al. |
| 2013/0189005 | A1 | 7/2013 | Saito et al. |
| 2013/0209147 | A1 | 8/2013 | Ogawa et al. |
| 2013/0236225 | A1 | 9/2013 | Ogawa et al. |
| 2013/0294802 | A1 | 11/2013 | Yamamoto et al. |
| 2014/0270865 | A1 | 9/2014 | Yamaji et al. |
| 2015/0168897 | A1 | 6/2015 | Ogawa et al. |
| 2015/0253708 | A1 | 9/2015 | Hirose et al. |
| 2015/0261154 | A1 | 9/2015 | Nozawa et al. |
| 2016/0070218 | A1 | 3/2016 | Hirose et al. |
| 2016/0124361 | A1 | 5/2016 | Watanabe et al. |
| 2016/0139549 | A1 | 5/2016 | Nozawa et al. |
| 2016/0306306 | A1 | 10/2016 | Nozawa et al. |

FOREIGN PATENT DOCUMENTS

| | | |
|---|---|---|
| JP | 2003-076201 | 3/2003 |
| JP | 2005-284013 | 10/2005 |
| JP | 2006-091268 | 4/2006 |
| JP | 2006-235041 | 9/2006 |
| JP | 2006-243211 | 9/2006 |
| JP | 2006-243471 | 9/2006 |
| JP | 2006-267860 | 10/2006 |
| JP | 2007-057682 | 3/2007 |
| JP | 2007-065082 | 3/2007 |
| JP | 2007-065092 | 3/2007 |
| JP | 2007-114698 | 5/2007 |
| JP | 2007-121407 | 5/2007 |
| JP | 2007-147905 | 6/2007 |
| JP | 2007-164025 | 6/2007 |
| JP | 2007-199383 | 8/2007 |
| JP | 2008-129164 | 6/2008 |
| JP | 2008-233232 | 10/2008 |
| JP | 2015-018906 | 1/2015 |

* cited by examiner

FIXING DEVICE AND IMAGE FORMING APPARATUS WITH A MOVABLE PRESSER WHICH MOVES A FIXING BELT

CROSS-REFERENCE TO RELATED APPLICATIONS

This patent application is based on and claims priority pursuant to 35 U.S.C. § 119 to Japanese Patent Application Nos. 2016-055924, filed on Mar. 18, 2016, and 2016-090871, filed on Apr. 28, 2016, in the Japanese Patent Office, the entire disclosure of each of which is hereby incorporated by reference herein.

BACKGROUND

Technical Field

Exemplary aspects of the present disclosure relate to a fixing device and an image forming apparatus, and more particularly, to a fixing device for fixing a toner image on a recording medium and an image forming apparatus incorporating the fixing device.

Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and a pressure rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the pressure rotator apply heat and pressure to the recording medium, melting and fixing the toner image on the recording medium.

SUMMARY

This specification describes below an improved fixing device. In one exemplary embodiment, the fixing device includes a fixing belt that is endless and rotatable in a rotation direction and a nip former stretching the fixing belt. A pressure rotator presses against the nip former via the fixing belt to form a fixing nip between the fixing belt and the pressure rotator, through which a recording medium is conveyed. A presser is disposed downstream from an exit of the fixing nip in the rotation direction of the fixing belt. The presser brings the fixing belt into contact with the pressure rotator. A mover is coupled to the presser to move the presser between a contact position where the presser brings the fixing belt into contact with the pressure rotator and an isolation position where the presser isolates the fixing belt from the pressure rotator.

This specification further describes an improved image forming apparatus. In one exemplary embodiment, the image forming apparatus includes an image forming device to form a toner image and a fixing device disposed downstream from the image forming device in a recording medium conveyance direction to fix the toner image on a recording medium. The fixing device includes a fixing belt that is endless and rotatable in a rotation direction and a nip former stretching the fixing belt. A pressure rotator presses against the nip former via the fixing belt to form a fixing nip between the fixing belt and the pressure rotator, through which the recording medium is conveyed. A presser is disposed downstream from an exit of the fixing nip in the rotation direction of the fixing belt. The presser brings the fixing belt into contact with the pressure rotator. A mover is coupled to the presser to move the presser between a contact position where the presser brings the fixing belt into contact with the pressure rotator and an isolation position where the presser isolates the fixing belt from the pressure rotator.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
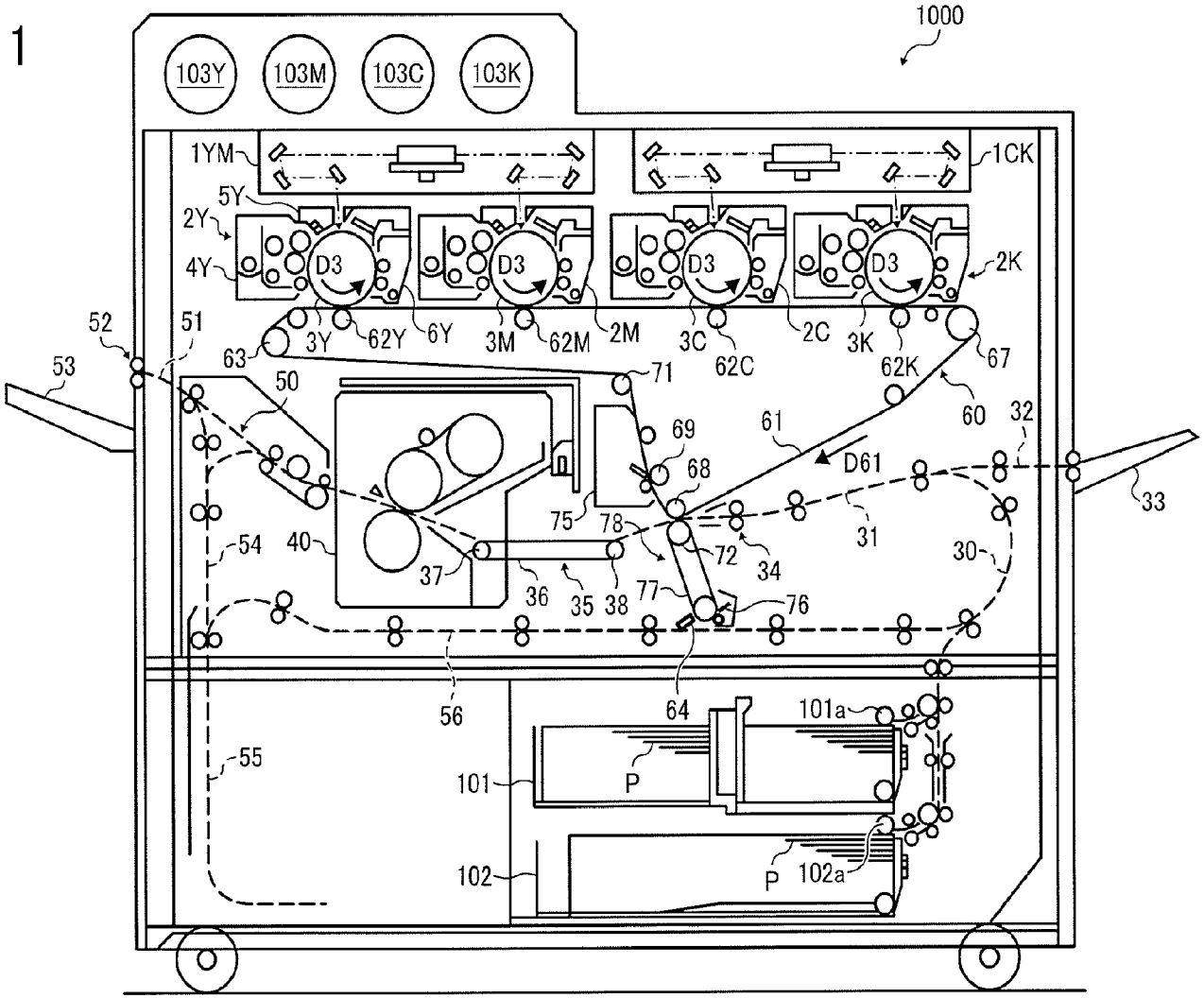
FIG. 1 is a schematic vertical cross-sectional view of an image forming apparatus according to an exemplary embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION OF THE DISCLOSURE

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring now to the drawings, wherein like reference numerals designate identical or corresponding parts throughout the several views, particularly to FIG. 1, an image forming apparatus 1000 according to an exemplary embodiment is explained.

FIG. 1 is a schematic vertical cross-sectional view of the image forming apparatus 1000. The image forming apparatus 1000 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1000 is a color printer that forms color and monochrome toner images on a recording medium by electrophotography. Alternatively, the image forming apparatus 1000 may be a monochrome printer that forms a monochrome toner image on a recording medium.

Referring to FIG. 1, a description is provided of a construction of the image forming apparatus 1000.

The image forming apparatus 1000 includes four image forming units 2Y, 2M, 2C, and 2K that form yellow (Y), magenta (M), cyan (C), and black (K) toner images, respectively. The image forming apparatus 1000 employs a tandem system in which the four image forming units 2Y, 2M, 2C, and 2K are aligned in a rotation direction D61 of an intermediate transfer belt 61 serving as an endless belt that bears toner images as described below.

The image forming apparatus 1000 further includes a feeding path 30, a pre-transfer conveyance path 31, a bypass feeding path 32, a bypass tray 33, a registration roller pair 34, a conveyance belt unit 35, a fixing device 40, a conveyance switch device 50, an output path 51, an output roller pair 52, and an output tray 53. The image forming apparatus 1000 further includes two optical writing units 1YM and 1CK, a primary transfer unit 60, a secondary transfer unit 78, a first paper tray 101, and a second paper tray 102.

The image forming units 2Y, 2M, 2C, and 2K include drum-shaped photoconductors 3Y, 3M, 3C, and 3K, respectively, each of which serves as a latent image bearer that bears an electrostatic latent image. Each of the first paper tray 101 and the second paper tray 102 accommodates a sheaf of sheets P serving as a plurality of recording media. As one of feeding rollers 101*a* and 102*a* is driven and rotated selectively, the one of the feeding rollers 101*a* and 102*a* feeds an uppermost sheet P of the sheaf of sheets P toward the feeding path 30.

The bypass tray 33 is attached to a side face of a body of the image forming apparatus 1000 such that the bypass tray 33 is opened and closed relative to the body. A user opens the bypass tray 33 relative to the body of the image forming apparatus 1000 and places a sheaf of sheets P on a top face of the bypass tray 33. A feeding roller attached to the bypass tray 33 feeds an upper most sheet P of the sheaf of sheets P placed on the bypass tray 33 toward the feeding path 30.

A detailed description is now given of a construction of the two optical writing units 1YM and 1CK.

Each of the two optical writing units 1YM and 1CK includes a laser diode, a polygon mirror, and various lenses. The optical writing units 1YM and 1CK drive the laser diodes according to image data created by a scanner separately provided from the image forming apparatus 1000 as the scanner reads an image or image data sent from a client computer. The laser diodes emit laser beams that optically scan the photoconductors 3Y, 3M, 3C, and 3K of the image forming units 2Y, 2M, 2C, and 2K, respectively. For example, a driver drives and rotates the photoconductors 3Y, 3M, 3C, and 3K of the image forming units 2Y, 2M, 2C, and 2K, respectively, counterclockwise in FIG. 1 in a rotation direction D3. The optical writing unit 1YM emits a laser beam onto each of the photoconductors 3Y and 3M rotating in the rotation direction D3 while deflecting the laser beam in an axial direction of each of the photoconductors 3Y and 3M, thus performing an optical scanning process. Thus, an electrostatic latent image is formed on each of the photoconductors 3Y and 3M according to yellow and magenta image data, respectively. Similarly, the optical writing unit 1CK emits a laser beam onto each of the photoconductors 3C and 3K rotating in the rotation direction D3 while deflecting the laser beam in an axial direction of each of the photoconductors 3C and 3K, thus performing an optical scanning process. Thus, an electrostatic latent image is formed on each of the photoconductors 3C and 3K according to cyan and black image data, respectively.

A detailed description is now given of a construction of the image forming units 2Y, 2M, 2C, and 2K.

The image forming units 2Y, 2M, 2C, and 2K include the photoconductors 3Y, 3M, 3C, and 3K, serving as latent image bearers, and various devices surrounding the photoconductors 3Y, 3M, 3C, and 3K, which are formed into four units, respectively. Each of the four units is supported by a common support and detachably attached to the body of the image forming apparatus 1000. The four image forming units 2Y, 2M, 2C, and 2K have a substantially identical construction except for the color (e.g., yellow, magenta, cyan, and black) of toner used in the image forming units 2Y, 2M, 2C, and 2K. Taking the image forming unit 2Y that forms a yellow toner image, for example, the image forming unit 2Y includes a developing device 4Y in addition to the photoconductor 3Y. The developing device 4Y supplies yellow toner to the electrostatic latent image formed on an outer circumferential surface of the photoconductor 3Y, thus developing the electrostatic latent image into the yellow toner image. The image forming unit 2Y further includes a charger 5Y and a drum cleaner 6Y. The charger 5Y uniformly charges the outer circumferential surface of the photoconductor 3Y while the photoconductor 3Y is driven and rotated. After the yellow toner image formed on the photoconductor 3Y passes through a primary transfer nip described below, the drum cleaner 6Y removes residual toner failed to be transferred onto the intermediate transfer belt 61 and therefore remaining on the outer circumferential surface of the photoconductor 3Y therefrom.

The photoconductor 3Y is a drum constructed of an element tube made of aluminum or the like and a photosensitive layer coating the element tube and being made of an organic sensitive material having photosensitivity. Alternatively, the photoconductor 3Y may be an endless belt instead of the drum.

The developing device 4Y includes a developing sleeve and a magnet roller. The developing sleeve is rotatable and made of a non-magnetic pipe. The magnet roller is disposed in a hollow of the developing sleeve such that the magnet roller does not rotate in accordance with rotation of the developing sleeve. The magnet roller generates a magnetic force that develops the electrostatic latent image formed on the photoconductor 3Y with a two-component developer (hereinafter referred to as a developer) that contains magnetic carrier particles and non-magnetic yellow toner particles that is supplied onto an outer circumferential surface of the developing sleeve. A potential difference between a potential of a developing bias applied to the developing sleeve and a potential of the electrostatic latent image formed on the photoconductor 3Y applies a developing potential to the yellow toner particles on the developing sleeve, which are disposed opposite the electrostatic latent image formed on the photoconductor 3Y. Conversely, a potential difference between the potential of the developing bias and a potential of a background portion on the photoconductor 3Y applies a background potential to the yellow toner particles on the developing sleeve, which are disposed opposite the background portion on the photoconductor 3Y. The developing potential and the background potential selectively adhere the yellow toner particles on the developing sleeve to the electrostatic latent image on the photoconductor 3Y, not to the background portion, thus developing the electrostatic latent image into the yellow toner image.

A yellow toner supply device supplies yellow toner, that is, yellow toner particles, contained in a yellow toner bottle 103Y to the developing device 4Y in a proper amount. A toner density sensor serving as a toner density detector is disposed in the developing device 4Y. The toner density sensor detects a magnetic permeability of the developer that is caused by carrier particles as a magnetic material. A main controller described below controls driving of the yellow toner supply device based on a comparison between an output value output by the toner density sensor and a target output value, that is, a target toner density value, output by the toner density sensor, thus adjusting a density of toner contained in the developer within a predetermined range (e.g., a range of from 4 weight percent to 9 weight percent). Similarly, the main controller controls driving of a magenta toner supply device, a cyan toner supply device, and a black toner supply device that supply magenta toner, cyan toner, and black toner supplied from a magenta toner bottle 103M, a cyan toner bottle 103C, and a black toner bottle 103K to developing devices of the image forming units 2M, 2C, and 2K, respectively.

The drum cleaner 6Y includes a cleaning blade made of polyurethane rubber. The cleaning blade contacts the photoconductor 3Y to scrape residual toner failed to be transferred onto the intermediate transfer belt 61 and therefore remaining on the photoconductor 3Y from the outer circumferential surface of the photoconductor 3Y. Alternatively, the drum cleaner 6Y may employ other cleaning method. In order to enhance cleaning performance, the drum cleaner 6Y includes a rotatable fur brush that contacts the photoconductor 3Y in addition to the cleaning blade. The fur brush also scrapes a fine, powdery lubricant off a solid lubricant and applies the fine, powdery lubricant to the outer circumferential surface of the photoconductor 3Y.

Above the photoconductor 3Y is a discharge lamp. The discharge lamp is a part of the image forming unit 2Y. The discharge lamp is disposed downstream from the drum cleaner 6Y in the rotation direction D3 of the photoconductor 3Y and discharges the outer circumferential surface of the photoconductor 3Y by optical illumination. The charger 5Y uniformly charges the discharged outer circumferential surface of the photoconductor 3Y. Thereafter, the optical writing unit 1YM performs optical scanning as described above. The charger 5Y is driven and rotated while the charger 5Y receives a charging bias from a power supply. Alternatively, the charger 5Y may employ a scorotron charger that charges the photoconductor 3Y without contacting the photoconductor 3Y.

The above describes the construction of the image forming unit 2Y that forms the yellow toner image. Each of the image forming units 2M, 2C, and 2K that form the magenta, cyan, and black toner images, respectively, has a construction similar to the construction of the image forming unit 2Y.

A detailed description is now given of a construction of the primary transfer unit 60.

Below the four image forming units 2Y, 2M, 2C, and 2K is the primary transfer unit 60. The primary transfer unit 60 includes the intermediate transfer belt 61 serving as an image bearer stretched taut across a plurality of rollers (e.g., rollers 63, 67, 69, and 71). While the intermediate transfer belt 61 contacts the photoconductors 3Y, 3M, 3C, and 3K, one of the plurality of rollers is driven and rotated to rotate the intermediate transfer belt 61 clockwise in FIG. 1 in the rotation direction D61. Accordingly, four primary transfer nips are formed between the four photoconductors 3Y, 3M, 3C, and 3K and the intermediate transfer belt 61, respectively. At the primary transfer nips, the yellow, magenta, cyan, and black toner images formed on the photoconductors 3Y, 3M, 3C, and 3K, respectively, are primarily transferred onto the intermediate transfer belt 61.

In proximity to the four primary transfer nips are primary transfer rollers 62Y, 62M, 62C, and 62K disposed inside a loop formed by the intermediate transfer belt 61. The primary transfer rollers 62Y, 62M, 62C, and 62K press the intermediate transfer belt 61 against the photoconductors 3Y, 3M, 3C, and 3K, respectively. A primary transfer power supply applies a primary transfer bias to each of the primary transfer rollers 62Y, 62M, 62C, and 62K. Accordingly, a primary transfer electric field that electrostatically transfers the yellow, magenta, cyan, and black toner images formed on the photoconductors 3Y, 3M, 3C, and 3K, respectively, onto the intermediate transfer belt 61 is produced at each of the four primary transfer nips.

As the intermediate transfer belt 61 rotates clockwise in FIG. 1 in the rotation direction D61 and passes through the four primary transfer nips successively, the yellow, magenta, cyan, and black toner images formed on the four photoconductors 3Y, 3M, 3C, and 3K, respectively, are primarily transferred onto an outer circumferential surface of the intermediate transfer belt 61 at the four primary transfer nips successively such that the yellow, magenta, cyan, and black toner images are superimposed on a same position on the intermediate transfer belt 61. Accordingly, the outer circumferential surface of the intermediate transfer belt 61 bears the yellow, magenta, cyan, and black toner images superimposed thereon.

A detailed description is now given of a construction of the secondary transfer unit 78.

Below the intermediate transfer belt 61 is the secondary transfer unit 78. The secondary transfer unit 78 includes an endless, secondary transfer belt 77, a grounded driven roller 72, a driving roller, a secondary transfer belt cleaner 76, and a toner adhesion amount sensor 64. The secondary transfer belt 77 is stretched taut across the grounded driven roller 72 and the driving roller that are disposed inside a loop formed by the secondary transfer belt 77. As the driving roller is driven and rotated, the driving roller rotates the secondary transfer belt 77 counterclockwise in FIG. 1.

The secondary transfer belt 77 of the secondary transfer unit 78 at a looped position where the secondary transfer belt 77 is looped over the grounded driven roller 72 contacts the intermediate transfer belt 61 of the primary transfer unit 60 at a looped position where the intermediate transfer belt 61 is looped over a secondary transfer bias roller 68, thus forming a secondary transfer nip between the intermediate transfer belt 61 and the secondary transfer belt 77. The secondary transfer bias roller 68 disposed inside the loop formed by the intermediate transfer belt 61 is applied with a secondary transfer bias output by a secondary transfer power supply described below. Conversely, the grounded driven roller 72 disposed inside the loop formed by the secondary transfer belt 77 is grounded. Accordingly, a secondary transfer electric field is created at the secondary transfer nip.

On the right of the secondary transfer nip in FIG. 1 is the registration roller pair 34 that feeds the sheet P sandwiched between two rollers of the registration roller pair 34 to the secondary transfer nip at a time when the yellow, magenta, cyan, and black toner images superimposed on the intermediate transfer belt 61 reach the secondary transfer nip. At the secondary transfer nip, the yellow, magenta, cyan, and black toner images superimposed on the intermediate transfer belt 61 are secondarily transferred onto the sheet P collectively under the secondary transfer electric field and pressure. Thus, the transferred, yellow, magenta, cyan, and black toner images form a full color toner image with a white background on the sheet P.

After passing through the secondary transfer nip, the outer circumferential surface of the intermediate transfer belt 61 is adhered with residual toner failed to be secondarily transferred onto the sheet P. An intermediate transfer belt cleaner 75 of the primary transfer unit 60 removes the residual toner from the outer circumferential surface of the intermediate transfer belt 61.

A detailed description is now given of a construction of the conveyance belt unit 35.

After passing through the secondary transfer nip, the sheet P is separated from the intermediate transfer belt 61 and the secondary transfer belt 77 and is delivered to the conveyance belt unit 35. The conveyance belt unit 35 includes a driving roller 37, a driven roller 38, and an endless, conveyance belt 36 stretched taut across the driving roller 37 and the driven roller 38. As the driving roller 37 is driven and rotated, the driving roller 37 rotates the conveyance belt 36 counterclockwise in FIG. 1. While an upper stretched face of the conveyance belt 36 carries the sheet P delivered from the secondary transfer nip, the conveyance belt 36 delivers the sheet P to the fixing device 40 as the conveyance belt 36 rotates counterclockwise in FIG. 1.

A detailed description is now given of a construction of the fixing device 40.

The sheet P sent to the fixing device 40 is sandwiched between an endless, fixing belt and a pressure roller at a fixing nip formed between the fixing belt and the pressure roller. The fixing belt and the pressure roller fix the full color toner image on a surface of the sheet P under heat and pressure.

A detailed description is now given of a construction of the conveyance switch device 50.

The sheet P secondarily transferred with the full color toner image on a first side of the sheet P at the secondary transfer nip and fixed with the full color toner image on the first side of the sheet P by the fixing device 40 is sent to the conveyance switch device 50. The image forming apparatus 1000 includes the conveyance switch device 50, a refeeding path 54, a switch-back path 55, and a post switch-back conveyance path 56, which construct a refeeder. The conveyance switch device 50 switches destination of the sheet P received from the fixing device 40 between the output path 51 and the refeeding path 54.

For example, if the image forming apparatus 1000 receives a one-sided print job to form a toner image on the first side of the sheet P, the conveyance switch device 50 directs the sheet P to the output path 51. The conveyance switch device 50 sends the sheet P bearing the toner image on the first side of the sheet P to the output roller pair 52 through the output path 51. The output roller pair 52 ejects the sheet P onto the output tray 53 disposed outside the body of the image forming apparatus 1000. If the image forming apparatus 1000 receives a two-sided print job to form a toner image on both sides, that is, the first side and a second side, of the sheet P, the conveyance switch device 50 directs the sheet P bearing the toner image on both sides of the sheet P to the output path 51 as the conveyance switch device 50 receives the sheet P from the fixing device 40. The conveyance switch device 50 sends the sheet P bearing the toner image on both sides of the sheet P to the output tray 53 disposed outside the body of the image forming apparatus 1000.

Conversely, if the image forming apparatus 1000 receives a two-sided print job to form a toner image on both sides of the sheet P, the conveyance switch device 50 directs the sheet P bearing the toner image on the first side of the sheet P to the refeeding path 54 as the conveyance switch device 50 receives the sheet P bearing the toner image on the first side on the sheet P from the fixing device 40. Since the refeeding path 54 is coupled to the switch-back path 55, the sheet P sent to the refeeding path 54 enters the switch-back path 55. When the sheet P enters the switch-back path 55 entirely in a sheet conveyance direction, the switch-back path 55 reverses the sheet conveyance direction of the sheet P to switch back the sheet P. Since the post switch-back conveyance path 56, in addition to the refeeding path 54, is coupled to the switch-back path 55, the sheet P that is switched back enters the post switch-back conveyance path 56. Accordingly, the sheet P is reversed. The reversed sheet P is resent to the secondary transfer nip through the post switch-back conveyance path 56 and the feeding path 30. The sheet P secondarily transferred with another toner image on the second side of the sheet P at the secondary transfer nip is sent to the fixing device 40 where the another toner image is fixed on the second side of the sheet P. Thereafter, the sheet P bearing the fixed toner image is ejected onto the output tray 53 through the conveyance switch device 50, the output path 51, and the output roller pair 52.

A description is provided of a construction of the fixing device 40 incorporated in the image forming apparatus 1000 having the construction described above.

Figure 2:
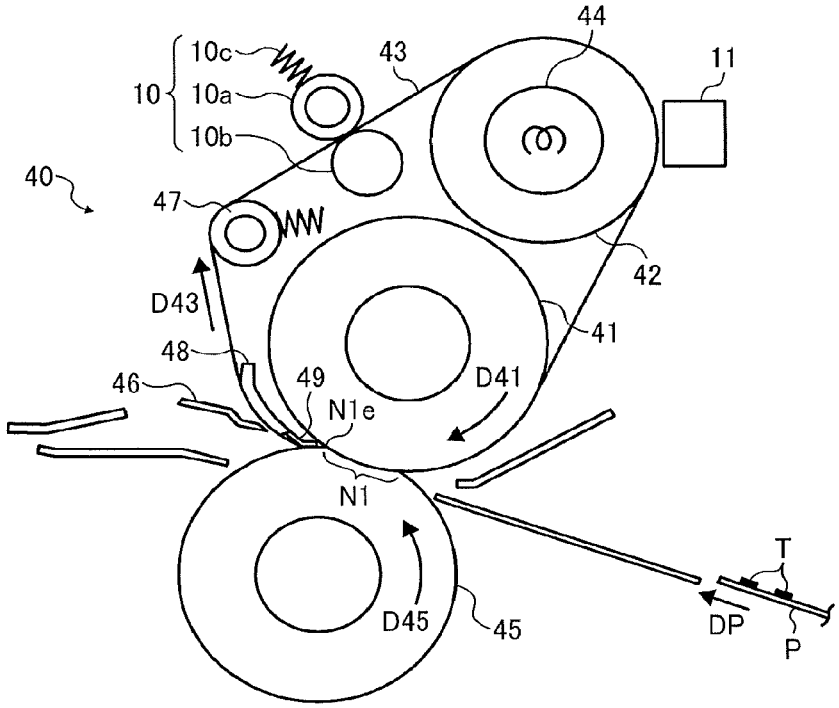
FIG. 2 is a vertical cross-sectional view of a fixing device incorporated in the image forming apparatus depicted in FIG. 1.

FIG. 2 is a schematic vertical cross-sectional view of the fixing device 40. As illustrated in FIG. 2, the fixing device 40 (e.g., a fuser or a fusing unit) employs a belt fixing system and includes a fixing belt 43 rotatable in a rotation direction D43 and a pressure roller 45 serving as a pressure rotator disposed opposite the fixing belt 43 and rotatable in a rotation direction D45. The fixing belt 43 is stretched taut across a fixing roller 41, a heating roller 42, a tension roller 47, and the like. A shaft of each of the fixing roller 41, the heating roller 42, and the pressure roller 45 is rotatably mounted on a frame of the fixing device 40 and extends in a longitudinal direction of the frame of the fixing device 40.

A detailed description is now given of a construction of the fixing belt 43.

The fixing belt 43 is an endless belt constructed of a polyimide (PI) layer and an outer circumferential surface layer coating the PI layer and being made of an offset inhibitor such as tetrafluoroethylene-perfluoroalkylvinylether copolymer (PFA) film. Each of the fixing roller 41 and the pressure roller 45 is a rubber roller. As the pressure roller 45 is pressed against the fixing roller 41 radially via the fixing belt 43, a fixing nip N1 is formed between the pressure roller 45 and the fixing belt 43. The tension roller 47 places tension to the fixing belt 43. The tension roller 47 includes an aluminum tube that is tubular or cylindrical.

A detailed description is now given of a construction of the pressure roller 45.

The pressure roller 45 separably contacts the fixing belt 43. While a sheet P is conveyed through the fixing device 40 for a fixing job, a pressurization assembly presses the pressure roller 45 against the fixing belt 43 to form the fixing nip N1 therebetween. Conversely, while the fixing device 40 is in a standby mode to wait for the fixing job, the pressurization assembly releases pressure exerted to the pressure roller 45 to separate the pressure roller 45 from the fixing belt 43.

A detailed description is now given of a construction of the heating roller 42.

The heating roller 42 is a hollow roller being made of aluminum or iron and accommodating a heater 44 (e.g., a halogen heater) serving as a heater or a heat source. Alternatively, the heater 44 may be an induction heater (IH). A thermistor 11 (e.g., a temperature sensor element) is disposed opposite the heating roller 42 via the fixing belt 43. The heater 44 is controlled based on a temperature of the fixing belt 43 that is detected by the thermistor 11 so that the heater 44 heats the fixing belt 43 to a target temperature.

A detailed description is now given of a configuration of the fixing roller 41.

A driver (e.g., a motor and a reduction gear train) is coupled to the fixing roller 41 to drive and rotate the fixing roller 41 clockwise in FIG. 2 in a rotation direction D41. As the fixing roller 41 rotates in the rotation direction D41, the fixing roller 41 frictionally rotates the fixing belt 43 clockwise in FIG. 2 in the rotation direction D43 and the pressure roller 45 pressed against the fixing roller 41 via the fixing belt 43 counterclockwise in FIG. 2 in the rotation direction D45 at an identical rotation speed. Alternatively, the driver may be coupled to the pressure roller 45 to drive and rotate the pressure roller 45 which rotates the fixing belt 43 pressed by the pressure roller 45 and the fixing roller 41 in accordance with rotation of the pressure roller 45.

A description is provided of a construction of a polisher 10 incorporated in the fixing device 40.

The polisher 10 is interposed between the tension roller 47 and the heating roller 42 in the rotation direction D43 of the fixing belt 43. The polisher 10 polishes an outer circumferential surface of the fixing belt 43. The polisher 10 includes a polishing roller 10*a*, an opposed roller 10*b*, and a spring 10*c*. The polishing roller 10*a* contacts the outer circumferential surface of the fixing belt 43. The opposed roller 10*b* is disposed opposite the polishing roller 10*a* via the fixing belt 43. The spring 10*c* presses the polishing roller 10*a* against the fixing belt 43. Each of the polishing roller 10*a* and the opposed roller 10*b* comes into contact with and separates from the fixing belt 43. While the polishing roller 10*a* is not requested to polish the fixing belt 43, the polishing roller 10*a* and the opposed roller 10*b* are separated from the fixing belt 43 to extend the life of the fixing belt 43.

While the sheet P is conveyed through the fixing nip N1, burrs produced on the sheet P by cutting may scratch and damage the outer circumferential surface of the fixing belt 43, resulting in abrasion of the fixing belt 43. Accordingly, abrasion of an inboard span of the fixing belt 43 that corresponds to a width of a frequently used size sheet P in an axial direction of the fixing belt 43 is different from abrasion of an outboard span of the fixing belt 43 that is outboard from the inboard span in the axial direction of the fixing belt 43. Consequently, while a large sheet P having a width greater than the width of the frequently used size sheet P in the axial direction of the fixing belt 43 is conveyed over the fixing belt 43, since the large sheet P is conveyed over the outboard span of the fixing belt 43, abrasion of the outboard span of the fixing belt 43 may damage a toner image T on the large sheet P. To address this circumstance, according to this exemplary embodiment, the polishing roller 10*a* of the polisher 10 polishes the outer circumferential surface of the fixing belt 43, evening abrasion of the fixing belt 43 in the axial direction thereof and thereby preventing the fixing belt 43 from damaging the toner image T on the sheet P.

A description is provided of a configuration of a separation aid 48 incorporated in the fixing device 40.

The separation aid 48 serving as a first separator is disposed inside a loop formed by the fixing belt 43 and disposed downstream from the fixing nip N1 in the rotation direction D43 of the fixing belt 43. For example, the separation aid 48 is made of metal such as SUS stainless steel and a rigid body such as resin. The separation aid 48 is a curved block or a substantially arcuate block in cross-section. The separation aid 48 contacts an inner circumferential surface of the fixing belt 43 at a downstream position disposed downstream from the fixing nip N1 in the rotation direction D43 of the fixing belt 43. The fixing belt 43 is looped over the separation aid 48 such that the separation aid 48 stretches the fixing belt 43 in a separation direction in which the fixing belt 43 separates from the fixing roller 41 to change the rotation direction D43 of the fixing belt 43 sharply. For example, the separation aid 48 changes the rotation direction D43 of the fixing belt 43 sharply to increase a curvature of the fixing belt 43 and decrease a radius of curvature of the fixing belt 43. The increased curvature of the fixing belt 43 facilitates separation of the sheet P, improving separation performance of the fixing device 40.

The separation aid 48 includes an arcuate contact face that contacts the fixing belt 43. The fixing belt 43 slides over the arcuate contact face of the separation aid 48 smoothly.

The separation aid 48 further includes an arcuate opposed face that is disposed opposite the fixing roller 41 and curved along an outer circumferential surface of the fixing roller 41. Accordingly, the separation aid 48 is disposed inside a limited space inside the loop formed by the fixing belt 43 without contacting the fixing roller 41.

The separation aid 48 extends in an axial direction of the fixing roller 41 throughout the entire span of the fixing roller 41 in the axial direction thereof. Both lateral ends of the separation aid 48 in the axial direction of the fixing roller 41 are mounted on or secured to side faces of the frame of the fixing device 40, respectively. The separation aid 48 does not press against the pressure roller 45, enhancing durability of the pressure roller 45 and preventing a torque of the motor from increasing.

A description is provided of a configuration of a separation plate 46 and a presser 49 incorporated in the fixing device 40.

The separation plate 46 serving as a second separator is disposed opposite the separation aid 48 via the fixing belt 43. A front end of the separation plate 46 is disposed opposite the fixing belt 43 with a slight interval therebetween. The front end of the separation plate 46 is tapered off and has a sharp edge. The presser 49 is interposed between the fixing nip N1 and the separation aid 48 in the rotation direction D43 of the fixing belt 43 and in contact with the inner circumferential surface of the fixing belt 43. The presser 49 presses the fixing belt 43 against the pressure roller 45.

A description is provided of a fixing operation of the fixing device 40 to fix a toner image T on a sheet P.

As the sheet P bearing the toner image T is conveyed through the fixing nip N1, toner of the toner image T is melted and fixed on the sheet P under heat and pressure. The separation plate 46 and the like disposed downstream from an exit N1*e* of the fixing nip N1 in a sheet conveyance direction DP separate or peel the sheet P from the fixing belt 43. Thereafter, the sheet P is ejected from the fixing device 40. An ejection sensor is disposed in proximity to an exit of the fixing device 40 to detect that the sheet P has passed through the fixing nip N1 at a predetermined time. If the ejection sensor does not detect that the sheet P has passed through the fixing nip N1 at the predetermined time, the main controller determines that the sheet P is jammed at the fixing nip N1 and activates a jam handling mode in which the main controller notifies the user to remove the jammed sheet P from the fixing device 40.

A description is provided of a construction of a comparative fixing device 40C.

Figure 3:
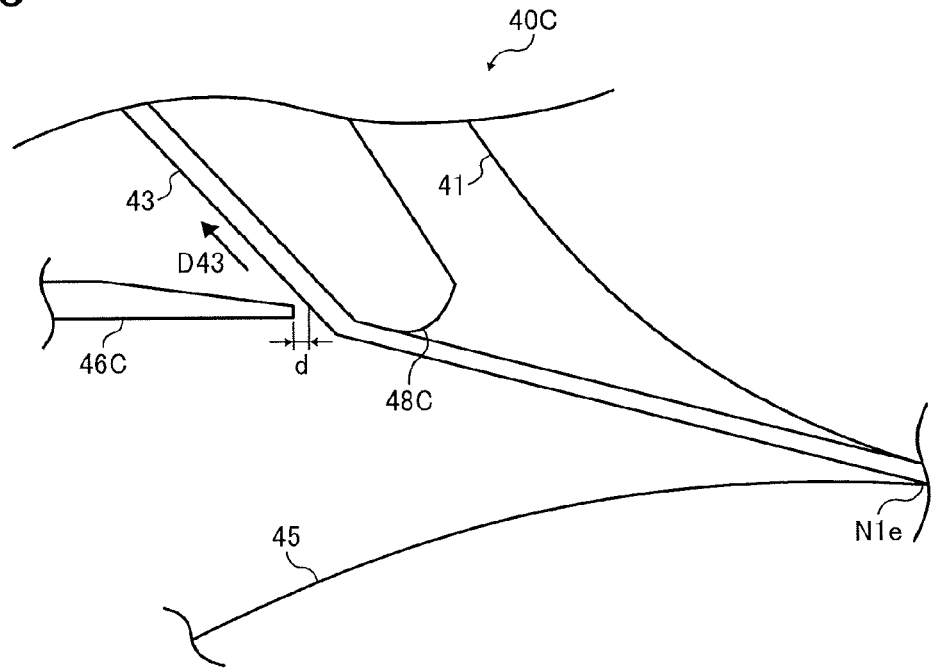
FIG. 3 is a partially enlarged, vertical cross-sectional view of a comparative fixing device.

FIG. 3 is a partially enlarged, vertical cross-sectional view of the comparative fixing device 40C, illustrating the exit N1*e* of the fixing nip N1. The comparative fixing device 40C includes a separation plate 46C that separates a sheet P from the fixing belt 43. For example, when a leading edge of a soft, thin sheet P such as thin paper that is not separated from the fixing belt 43 easily with the curvature of the fixing belt 43 comes into contact with a front edge of the separation plate 46C, the separation plate 46C separates the thin sheet P from the fixing belt 43. If the front edge of the separation plate 46C contacts the fixing belt 43, the separation plate 46C may shave the fixing belt 43, shortening the life of the fixing belt 43. In order to prohibit the front edge of the separation plate 46C from contacting the fixing belt 43 and allow the thin sheet P to come into contact with the separation plate 46C precisely, an interval d of about 0.2 mm between the fixing belt 43 and the separation plate 46C is requested to be retained precisely.

To address this request, a separation aid 48C disposed opposite the separation plate 46C via the fixing belt 43 is made of a rigid body to suppress change in the interval d between the fixing belt 43 and the separation plate 46C due to deformation of the separation aid 48C. If the separation aid 48C made of the rigid body presses against the pressure roller 45 via the fixing belt 43, the separation aid 48C may be deformed resiliently by pressure from the pressure roller 45, resulting in change in the interval d between the fixing belt 43 and the separation plate 46C. Further, the durability of the pressure roller 45 may decrease. As illustrated in Table 1 below, that indicates a result of a durability test of the pressure roller 45 and the fixing belt 43, if the separation aid 48C is retracted from the pressure roller 45 by a length of 2 mm, the separation aid 48C substantially doubles the life of the pressure roller 45 and the fixing belt 43.

TABLE 1

| Separation aid | Pressure roller | Fixing belt |
|---|---|---|
| Pressing against pressure roller with engagement of 0.5 mm | 600 kp | 600 kp |
| Pressing against pressure roller with engagement of 0 mm | 750 kp | 750 kp |
| Retracting from pressure roller by length of 2 mm | 1,400 kp | 1,400 kp |

However, since the separation aid 48C is spaced apart from the pressure roller 45, the sheet P adhered to the fixing belt 43 is not exerted with pressure from the pressure roller 45 in a separation span of the fixing belt 43 that is defined from a nip position disposed opposite the fixing nip N1 to a separation position disposed opposite the front edge of the separation plate 46C. As the sheet P is heated by the fixing belt 43 at the fixing nip N1, moisture contained in the sheet P is vaporized into steam. While the sheet P is conveyed through the fixing nip N1, since the sheet P receives substantial surface pressure of about 40 [N/cm$^2$], steam is not discharged from the sheet P. Conversely, when the sheet P is ejected from the fixing nip N1, since the sheet P receives no pressure, steam is discharged from the sheet P.

As illustrated in FIG. 3, a decreased gap between the pressure roller 45 and the fixing belt 43 stretched by the separation aid 48C at a position in proximity to the exit N1*e* of the fixing nip N1 is smaller than an increased gap between the pressure roller 45 and the fixing belt 43 wound around the fixing roller 41. Since heat is stored in the decreased gap between the pressure roller 45 and the fixing belt 43 stretched by the separation aid 48C, the temperature of the sheet P does not decrease and substantial steam is discharged from the sheet P. Steam is mainly discharged from a back side of the sheet P that is disposed opposite the pressure roller 45. The sheet P ejected from the fixing nip N1, while the sheet P is adhered to the fixing belt 43, is conveyed to the separation position of the fixing belt 43 that is disposed opposite the front edge of the separation plate 46C. A height of a non-image section on the sheet P that does not bear the toner image T is smaller than a height of an image section on the sheet P that bears the toner image T. Accordingly, a gap is produced between the fixing belt 43 and the non-image section on the sheet P. Steam is discharged from the sheet P to the gap. As the sheet P discharges steam, fiber of the sheet P dries. Accordingly, the sheet P shrinks and waves.

Steam mainly discharged from the back side of the sheet P that is disposed opposite the pressure roller 45 remains in the decreased gap between the pressure roller 45 and the fixing belt 43 stretched by the separation aid 48C. Steam is reabsorbed by the sheet P and moistens the sheet P. Steam discharged to the gap between the fixing belt 43 and the non-image section on the sheet P remains in the decreased gap. Steam is reabsorbed by the sheet P and moistens the sheet P. As the sheet P is moistened, fiber of the sheet P stretches. Accordingly, the sheet P waves.

Figure 4:
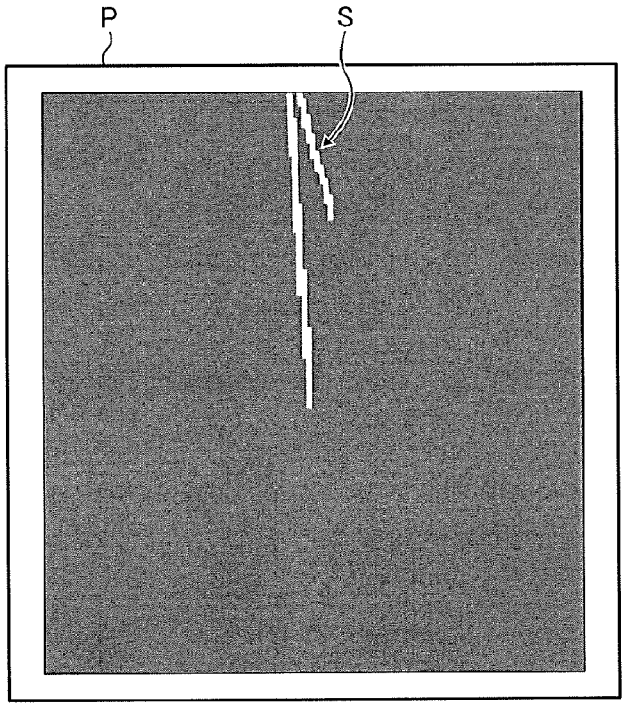
FIG. 4 is a plan view of a sheet having creases produced after the sheet passes through the comparative fixing device depicted in FIG. 3.

In the comparative fixing device 40C depicted in FIG. 3, while the sheet P is conveyed in the separation span of the fixing belt 43 that is defined from the nip position disposed opposite the fixing nip N1 to the separation position disposed opposite the front edge of the separation plate 46C, fiber of the sheet P suffers from contraction as the sheet P discharges steam and dries and expansion as the sheet P reabsorbs steam and moistens. Accordingly, the sheet P waves. As the waved sheet P is sandwiched by the output roller pair 52 or the like depicted in FIG. 1, the sheet P may suffer from creases S as illustrated in FIG. 4. FIG. 4 is a plan view of the sheet P having the creases S.

To address this circumstance, the fixing device 40 according to this exemplary embodiment depicted in FIG. 2 incorporates the presser 49 that is interposed between the fixing roller 41 and the separation aid 48 in the rotation direction D43 of the fixing belt 43 and in contact with the inner circumferential surface of the fixing belt 43. The presser 49 presses the fixing belt 43 against the pressure roller 45.

A detailed description is now given of a construction of the presser 49.

Figure 5:
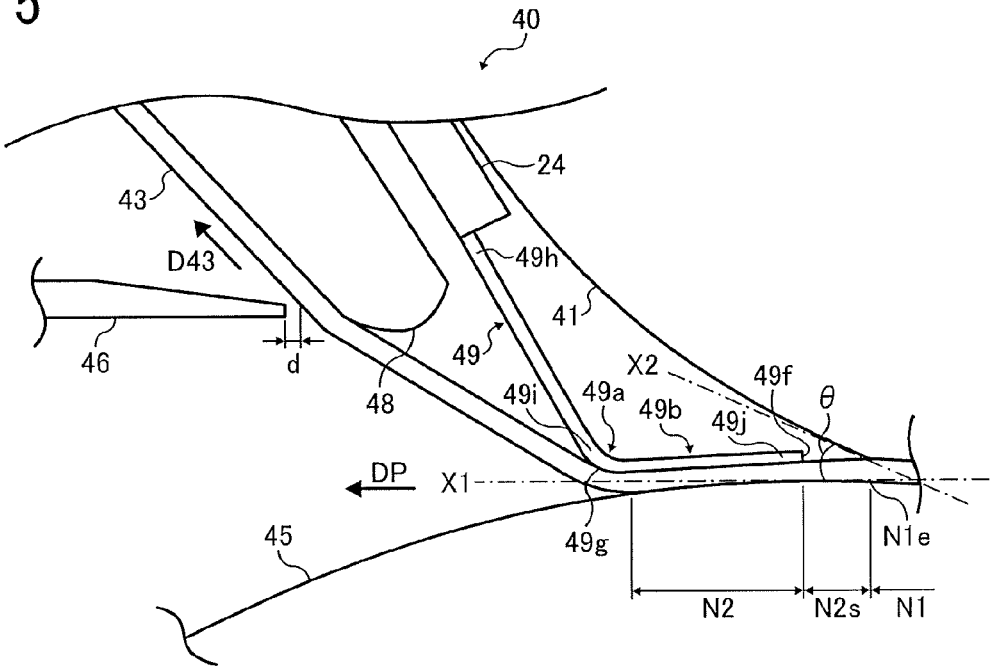
FIG. 5 is a partially enlarged, vertical cross-sectional view of the fixing device depicted in FIG. 2, illustrating a presser incorporated therein.

FIG. 5 is a partially enlarged, vertical cross-sectional view of the fixing device 40, illustrating components situated in proximity to the exit N1*e* of the fixing nip N1. The presser 49 is disposed inside the loop formed by the fixing belt 43 and interposed between the fixing roller 41 and the separation aid 48 in the rotation direction D43 of the fixing belt 43. The presser 49 is a plate made of metal such as SUS stainless steel and has a thickness of about 0.2 mm. One end of the presser 49 is supported by a support plate 24. The presser 49 extends from the support plate 24 toward the pressure roller 45. The presser 49 is bent toward the fixing nip N1 at an intermediate portion 49*i* of the presser 49, thus defining a flat spring shape. Since the presser 49 is bent at the intermediate portion 49*i* thereof, the presser 49 contacts the inner circumferential surface of the fixing belt 43. Hence, the presser 49 includes a pressing portion 49*b* and a peel-off portion 49*a* The pressing portion 49*b* presses the fixing belt 43 against the pressure roller 45. The peel-off portion 49*a* is curved and disposed downstream from the pressing portion 49*b* in the rotation direction D43 of the fixing belt 43.

The presser 49 engages the pressure roller 45 by 0.4 mm. The presser 49 is resiliently deformed to press the fixing belt 43 against the pressure roller 45 with a predetermined load. Accordingly, the presser 49 forms a post nip N2 that is disposed downstream from the fixing nip N1 in the sheet conveyance direction DP.

The pressing portion 49*b* of the presser 49 has a shape corresponding to an outer circumferential surface of the pressure roller 45 to press the fixing belt 43 against the pressure roller 45 evenly. At an exit 49*g* of the post nip N2, the rotation direction D43 of the fixing belt 43 changes sharply along a curve of the peel-off portion 49*a* of the presser 49. Accordingly, the curvature of the fixing belt 43 increases at the exit of the post nip N2. In other words, the radius of curvature of the fixing belt 43 decreases at the exit of the post nip N2. According to this exemplary embodiment, the peel-off portion 49*a* of the presser 49 is curved such that the radius of curvature of the fixing belt 43 is 6 mm at the exit of the post nip N2.

The sheet P ejected from the fixing nip N1 is conveyed while the sheet P receives pressure from the pressure roller 45 at the post nip N2 continuously after the sheet P receives pressure at the fixing nip N1. Since pressure exerted to the sheet P at the post nip N2 is smaller than pressure exerted to the sheet P at the fixing nip N1, the sheet P discharges steam at the post nip N2. As the sheet P discharges steam, the sheet P is susceptible to drying of fiber and shrinking. However, since the presser 49 presses the sheet P against the pressure roller 45 via the fixing belt 43, fiber of the sheet P does not shrink and therefore the sheet P is immune from waving caused by discharging of steam.

Steam discharged at the post nip N2 remains between the sheet P and the fixing belt 43 and the like as air bubbles and is reabsorbed by the sheet P, moistening the sheet P. However, while the sheet P absorbs steam, the presser 49 presses the sheet P against the pressure roller 45 via the fixing belt 43. Accordingly, even if fiber of the sheet P that absorbs steam and moistens is susceptible to stretch, since the presser 49 presses the sheet P against the pressure roller 45 via the fixing belt 43, fiber of the sheet P does not stretch and therefore the sheet P is immune from waving caused by absorption of steam.

Since the sheet P is immune from waving, even when the sheet P ejected from the fixing nip N1 is sandwiched and conveyed by the output roller pair 52 depicted in FIG. 1, the sheet P is immune from the streaked creases S illustrated in FIG. 4.

According to this exemplary embodiment, the presser 49 presses the sheet P against the pressure roller 45 via the fixing belt 43 to prevent fiber of the sheet P from contracting and expanding as the sheet P discharges and absorbs steam. Pressure with which the presser 49 presses the sheet P against the pressure roller 45 via the fixing belt 43 is sufficiently smaller than pressure with which the pressure roller 45 presses the sheet P against the fixing roller 41 via the fixing belt 43 at the fixing nip N1. According to this exemplary embodiment, pressure exerted to the sheet P at the post nip N2 is about 5 [N]. The presser 49 suppresses waving of the sheet P with pressure great enough to prevent the streaked creases S on the sheet P illustrated in FIG. 4. Hence, the presser 49 may press the fixing belt 43 toward the pressure roller 45 such that the fixing belt 43 is in contact with or in proximity to the pressure roller 45 with a slight interval between the fixing belt 43 and the pressure roller 45. In this case, when the sheet P is ejected from the fixing nip N1 and is susceptible to waving as the sheet P discharges and absorbs steam, the sheet P comes into contact with the pressure roller 45 or the fixing belt 43 which prevents the sheet P from waving further. Hence, even if the presser 49 presses the fixing belt 43 toward the pressure roller 45 such that the fixing belt 43 is in contact with or in proximity to the pressure roller 45 with the slight interval between the fixing belt 43 and the pressure roller 45, the presser 49 suppresses waving of the sheet P.

In a configuration in which the presser 49 presses the fixing belt 43 toward the pressure roller 45 such that the fixing belt 43 does not contact the pressure roller 45, if the slight interval between the fixing belt 43 and the pressure roller 45 is equivalent to a thickness of the sheet P, the sheet P ejected from the fixing nip N1 is conveyed while the sheet P is sandwiched between the fixing belt 43 and the pressure roller 45. Thus, the presser 49 suppresses waving of the sheet P more effectively.

At the exit of the post nip N2, the rotation direction D43 of the fixing belt 43 changes sharply along the curve of the peel-off portion 49*a* of the presser 49. Accordingly, the sheet P is separated from the fixing belt 43 by the curvature of the fixing belt 43 at the exit of the post nip N2. A soft sheet P such as thin paper or a sheet P bearing a toner image T extending to a leading end of the sheet P is not separated from the fixing belt 43 by the curvature of the fixing belt 43 at the exit of the post nip N2 and is conveyed to a separation position of the fixing belt 43 that is disposed opposite a front edge of the separation plate 46 while the sheet P adheres to the fixing belt 43. However, steam generated by the sheet P while the sheet P is conveyed through the fixing nip N1 is already discharged from the sheet P while the sheet P is conveyed through the post nip N2. Accordingly, steam is barely discharged from the sheet P while the sheet P moves to the separation position of the fixing belt 43 that is disposed opposite the front edge of the separation plate 46.

Additionally, an increased gap between the fixing belt 43 and the pressure roller 45 at a position in proximity to the exit of the post nip N2 is greater than the decreased gap between the pressure roller 45 and the fixing belt 43 depicted in FIG. 3. Accordingly, heat is not stored at the position in proximity to the exit of the post nip N2 and is dissipated to surroundings. Hence, while the sheet P moves to the separation position of the fixing belt 43 that is disposed opposite the front edge of the separation plate 46, the sheet P is barely heated by heat stored at the position in proximity to the exit of the post nip N2 and therefore barely discharges steam. Consequently, while the sheet P moves from the post nip N2 to the separation position of the fixing belt 43 that is disposed opposite the front edge of the separation plate 46, the sheet P barely discharges steam and dries and therefore barely waves.

Steam not reabsorbed by the sheet P at the post nip N2 is discharged to the surroundings at the exit of the post nip N2. However, since the increased gap between the fixing belt 43 and the pressure roller 45 at the position in proximity to the exit of the post nip N2 is greater than the decreased gap between the pressure roller 45 and the fixing belt 43 depicted in FIG. 3, steam does not accumulate at the position in proximity to the exit of the post nip N2. Accordingly, while the sheet P moves from the post nip N2 to the separation position of the fixing belt 43 that is disposed opposite the front edge of the separation plate 46, the sheet P barely reabsorbs steam. Consequently, while the sheet P moves from the post nip N2 to the separation position of the fixing belt 43 that is disposed opposite the front edge of the separation plate 46, the sheet P barely reabsorbs steam and moistens and therefore barely waves.

Since the presser 49 presses the fixing belt 43 against the pressure roller 45, the fixing belt 43 is hung freely without contacting any component in a free span defined from the exit of the post nip N2 to the separation aid 48 in the rotation direction D43 of the fixing belt 43. The free span of the fixing belt 43 of the fixing device 40 depicted in FIG. 5 is smaller than a free span of the fixing belt 43 that is defined from the exit N1*e* of the fixing nip N1 to the separation aid 48C of the comparative fixing device 40C in the rotation direction D43 of the fixing belt 43 depicted in FIG. 3.

A thermal capacity of the presser 49 made of a plate is smaller than a thermal capacity of the presser 49 made of a block, suppressing conduction of heat from the fixing belt 43 to the presser 49 formed in the plate. Accordingly, compared to the presser 49 made of the block, the presser 49 made of the plate shortens a waiting time for the user to wait until the fixing belt 43 is heated to a target temperature. Additionally, compared to the presser 49 made of the block, the presser 49 made of the plate suppresses power consumption, saving energy.

Since the presser 49 is made of a resilient material, the presser 49 deforms along the outer circumferential surface of the pressure roller 45 readily compared to the presser 49 made of a rigid body. Thus, the presser 49 presses the fixing belt 43 against the pressure roller 45 evenly with a predetermined load.

According to this exemplary embodiment, the sheet P separates from the fixing belt 43 at three separation positions thereon. The three separation positions include a first separation position where the fixing belt 43 is curved at the exit of the post nip N2 formed between the peel-off portion 49*a* of the presser 49 and the pressure roller 45; a second separation position where the fixing belt 43 is curved by the separation aid 48; and a third separation position where the fixing belt 43 is disposed opposite the front edge of the separation plate 46. Accordingly, the fixing belt 43 attaining the three separation positions separates the sheet P from the fixing belt 43 precisely, preventing the sheet P from being jammed between the fixing belt 43 and the pressure roller 45 effectively.

A description is provided of a first variation of the presser 49.

Figure 6:
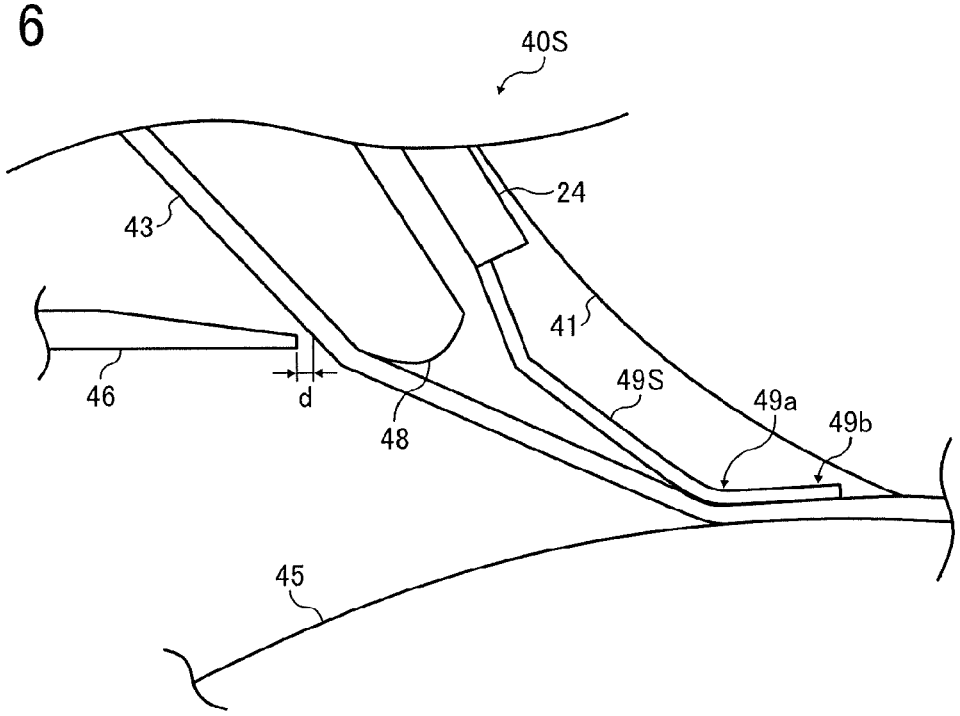
FIG. 6 is a partial vertical cross-sectional view of a fixing device incorporating a presser as a first variation of the presser depicted in FIG. 5.

FIG. 6 is a partial vertical cross-sectional view of a fixing device 40S incorporating a presser 49S as the first variation of the presser 49 depicted in FIG. 5. As illustrated in FIG. 6, a portion of the presser 49S that extends from the support plate 24 toward the pressure roller 45 is also bent at a position in proximity to the support plate 24. The presser 49S resiliently deforms readily to curve along the outer circumferential surface of the pressure roller 45 precisely, enhancing durability of the pressure roller 45.

A description is provided of a second variation of the presser 49.

Figure 7:
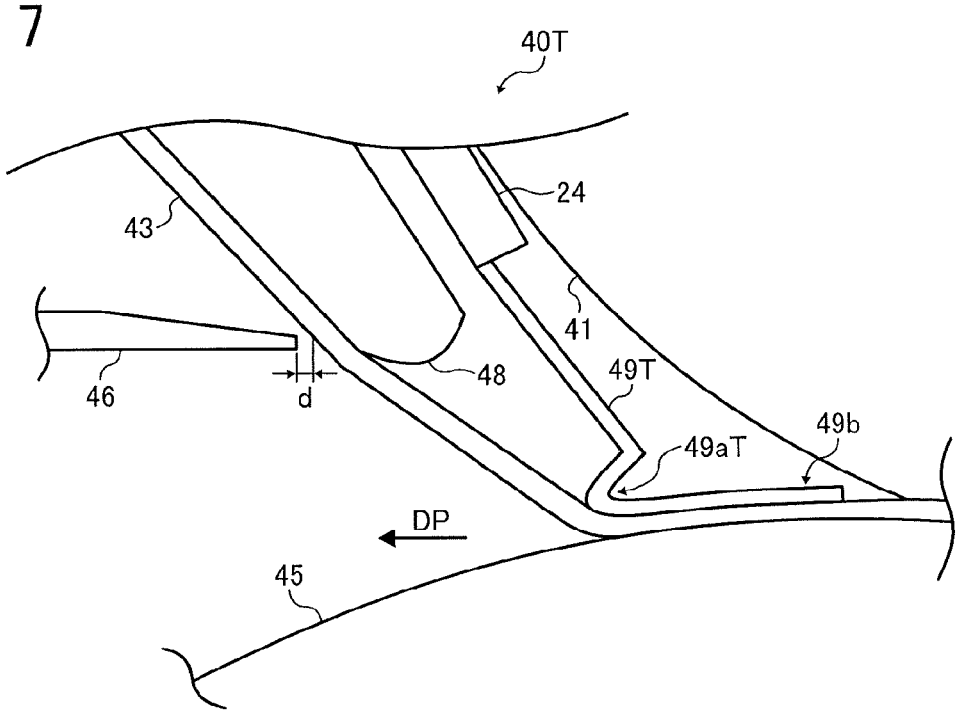
FIG. 7 is a partial vertical cross-sectional view of a fixing device incorporating a presser as a second variation of the presser depicted in FIG. 5.

FIG. 7 is a partial vertical cross-sectional view of a fixing device 40T incorporating a presser 49T as the second variation of the presser 49 depicted in FIG. 5. As illustrated in FIG. 7, the presser 49T includes a peel-off portion 49*a*T that projects from the pressing portion 49*b* in the sheet conveyance direction DP. The peel-off portion 49*a*T increases the curvature of the fixing belt 43 at the exit of the post nip N2 formed by the peel-off portion 49*a*T. In other words, the peel-off portion 49*a*T decreases the radius of curvature of the fixing belt 43 at the exit of the post nip N2, facilitating separation of the sheet P from the fixing belt 43 at the exit of the post nip N2.

A description is provided of two third variations of the presser 49.

Figure 8:
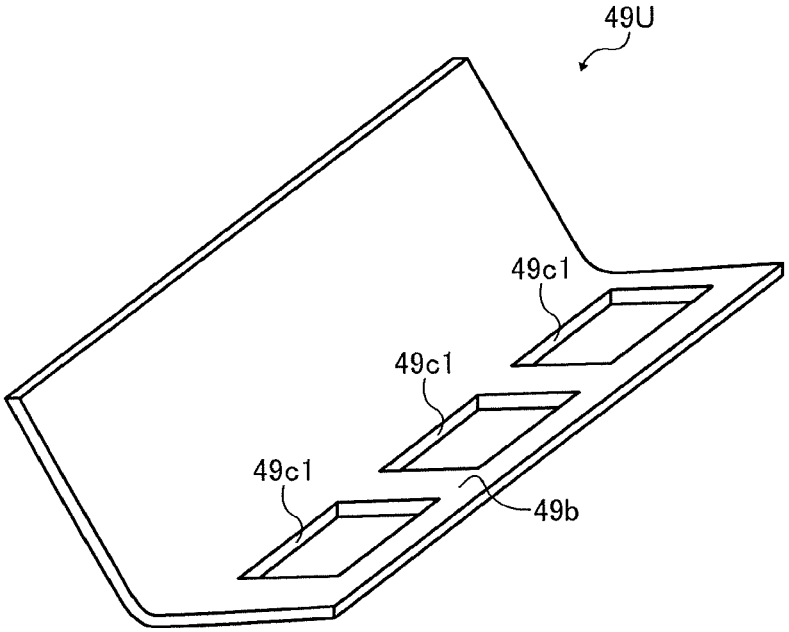
FIG. 8 is a perspective view of a presser as one of third variations of the presser depicted in FIG. 5.
Figure 9:
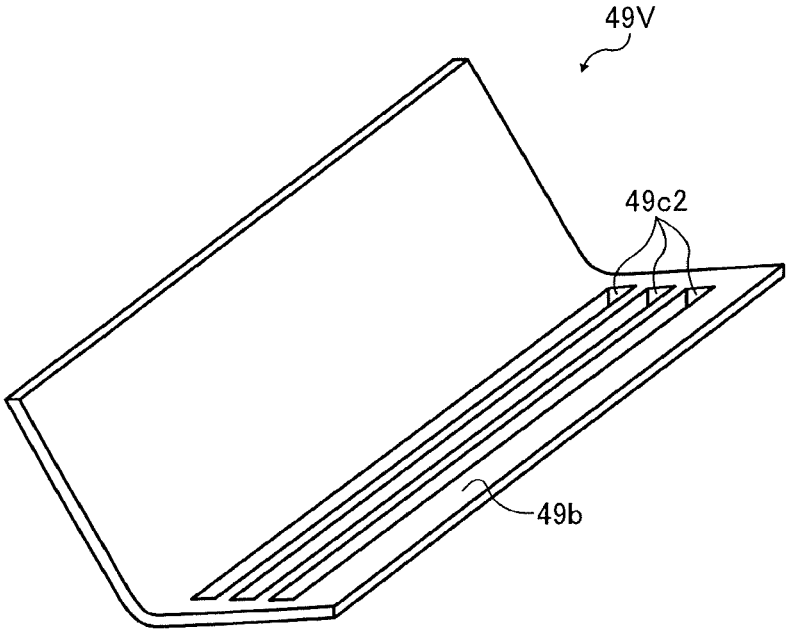
FIG. 9 is a perspective view of a presser as another one of the third variations of the presser depicted in FIG. 5.

FIG. 8 is a perspective view of a presser 49U as one of the third variations of the presser 49 depicted in FIG. 5. FIG. 9 is a perspective view of a presser 49V as another one of the third variations of the presser 49 depicted in FIG. 5. As illustrated in FIGS. 8 and 9, each of the pressers 49U and 49V includes an opening penetrating through the pressing portion 49*b*. For example, as illustrated in FIG. 8, the presser 49U includes a plurality of slots 49*c*1 serving as openings penetrating through the pressing portion 49*b*. As illustrated in FIG. 9, the presser 49V includes a plurality of slits 49*c*2 serving as openings penetrating through the pressing portion 49*b*. Accordingly, each of the pressers 49U and 49V has a decreased thermal capacity that shortens the waiting time for the user to wait until the fixing belt 43 is heated to the target temperature and saves energy.

As illustrated in FIG. 5, a front edge 49*f* of the pressing portion 49*b* of the presser 49 is disposed in proximity to the fixing roller 41. A border N2*s* is interposed between the fixing nip N1 and the post nip N2 in the sheet conveyance direction DP. At the post nip N2, the pressing portion 49*b* of the presser 49 presses the fixing belt 43 against the pressure roller 45. Conversely, at the border N2*s*, no component disposed inside the loop formed by the fixing belt 43 presses the fixing belt 43 against the pressure roller 45. Pressure with which the fixing belt 43 presses against the pressure roller 45 at the border N2*s* is smaller than pressure with which the fixing belt 43 presses against the pressure roller 45 at the post nip N2. If pressure exerted at the border N2*s* disposed upstream from the post nip N2 in the sheet conveyance direction DP is smaller than pressure exerted at the post nip N2, disadvantages may generate as described below. Since pressure exerted to the sheet P at the border N2*s* is smaller than pressure exerted to the sheet P at the fixing nip N1, the sheet P discharges steam at the border N2*s*. Accordingly, air bubbles generate between the sheet P and the fixing belt 43 and the like.

Additionally, as toner of the toner image T thermally expands, air contained in the toner of the toner image T leaks from the toner, generating air bubbles between the sheet P and the fixing belt 43. As the sheet P enters the post nip N2 exerted with pressure greater than pressure exerted to the border N2*s*, the air bubbles are pushed and moved by the presser 49 pressing against the pressure roller 45 via the fixing belt 43. Thus, the air bubbles move over the surface of the sheet P. Since the toner of the toner image T on the sheet P immediately after passing through the fixing nip N1 is not solidified completely, as the air bubbles move over the surface of the sheet P, the air bubbles may damage the toner image T, resulting in formation of a faulty toner image T having variation in gloss or the like.

To address this circumstance, the presser 49 presses the fixing belt 43 against the pressure roller 45 in an elongated span extending to a position in proximity to the fixing nip N1 to decrease the border N2*s*. The decreased border N2*s* suppresses generation of the air bubbles. For example, according to this exemplary embodiment, the presser 49 includes a downstream end 49*h* serving as a fixed end mounted on the support plate 24 and extending toward the pressure roller 45; the intermediate portion 49*i* bent toward the fixing nip N1; and an upstream end 49*j* serving as a free end in the rotation direction D43 of the fixing belt 43. Compared to a configuration in which the presser 49 is bent and directed in the sheet conveyance direction DP, not directed to the fixing nip N1, such that the downstream end 49*h* of the presser 49 in the rotation direction D43 of the fixing belt 43 is a free end, the presser 49 depicted in FIG. 5 is disposed in proximity to the fixing nip N1, decreasing the border N2*s*.

Similarly, in order to address the disadvantages described above, pressure exerted from the presser 49 to the fixing belt 43 is even or decreases in the sheet conveyance direction DP to cause pressure exerted from a downstream portion (e.g., the intermediate portion 49*i*) of the presser 49 in the sheet conveyance direction DP to be not greater than pressure exerted from an upstream portion (e.g., the upstream end 49*j*) of the presser 49 in the sheet conveyance direction DP. Accordingly, air bubbles produced by steam discharged from the sheet P are not pushed to the post nip N2 and do not move over the surface of the sheet P. Consequently, the presser 49 suppresses formation of a faulty toner image T having variation in gloss or the like at the post nip N2.

Table 2 below illustrates a result of an evaluation test of a length of the border N2*s* in the sheet conveyance direction DP.

TABLE 2

| Border N2s (mm) | Surface pressure exerted at border N2s ($N/cm^2$) | Prevention of variation in gloss of toner image |
|---|---|---|
| 5 | 3 | Very poor |
| 3 | 4 | Poor |
| 2.8 | 5 | Good (no variation in gloss) |
| 2.3 | 7 | Good (no variation in gloss) |
| 0 | 8 | Good (no variation in gloss) |

The evaluation test was performed with a solid toner image formed on an A3 size sheet under surface pressure of 40 [$N/cm^2$] exerted at the fixing nip N1 and surface pressure of 2.84 [$N/cm^2$] (0.29 [$kg/cm^2$]) exerted at the post nip N2. The solid toner image was visually checked to evaluate variation in gloss. Each of the surface pressures was measured with I-SCAN. In the "Prevention of variation in gloss of toner image" column of Table 2, good indicates that variation in gloss was not identified and evaluation is leveled as good. Very poor and poor indicate that variation in gloss was identified and evaluation is leveled as very poor and poor. The surface pressure exerted at the border N2*s* indicates an average pressure of pressures exerted in a span from the exit N1*e* of the fixing nip N1 to an upstream end (e.g., the front edge 49*f*) of the presser 49 in the sheet conveyance direction DP. The surface pressure exerted at the post nip N2 indicates an average pressure of pressures exerted in a span from the upstream end to a downstream end of the presser 49 in the sheet conveyance direction DP. The surface pressure exerted at the post nip N2 slightly decreases from an upstream end to a downstream end of the post nip N2 in the rotation direction D43 of the fixing belt 43. The surface pressure exerted at the upstream end of the post nip N2 in the rotation direction D43 of the fixing belt 43 is about 8 [$N/cm^2$].

As illustrated in Table 2, if the length of the border N2*s* in the rotation direction D43 of the fixing belt 43 is not greater than 2.8 mm, generation of air bubbles is suppressed at the border N2*s*, preventing air bubbles from being pushed out to the post nip N2 and moving over the surface of the sheet P. As a result, no variation in gloss appears on the solid toner image, attaining evaluation leveled as good.

As illustrated in FIG. 5, a tangent X1 to the pressure roller 45 at the exit N1*e* of the fixing nip N1 and a tangent X2 to the fixing roller 41 form an angle θ not smaller than 45 degrees. The evaluation test was performed with the angle θ of 13 degrees and 45 degrees. When the angle θ was 13 degrees, variation in gloss appeared. Conversely, when the angle θ was 45 degrees, variation in gloss did not appear. When the angle θ is 13 degrees, the sheet P conveyed through the position in proximity to the exit N1*e* of the fixing nip N1 is spaced apart from the fixing roller 41 with a small distance therebetween. Accordingly, the sheet P ejected from the fixing nip N1 is susceptible to heat from the fixing roller 41. Consequently, an amount of steam discharged from the sheet P at the border N2*s* and an amount of thermal expansion of air contained in toner of the toner image T on the sheet P increase and therefore the size of an air bubble generated at the border N2*s* increases easily. Hence, even if a difference between the surface pressure exerted at the border N2*s* and the surface pressure exerted at the post nip N2 is small, since the volume of the air bubble is great, the air bubble may be spread or enlarged as the air bubble receives pressure at the post nip N2, thus generating variation in gloss of the toner image T on the sheet P.

Conversely, when the angle θ is not smaller than 45 degrees, the sheet P is less susceptible to heat from the fixing roller 41 at the border N2*s*. Accordingly, the amount of steam discharged from the sheet P at the border N2*s* and the amount of thermal expansion of air contained in toner of the toner image T on the sheet P decrease and therefore the size of the air bubble generated at the border N2*s* does not increase. Consequently, the air bubble may barely be spread or enlarged as the air bubble receives pressure at the post nip N2. Thus, variation in gloss of the toner image T on the sheet P is not identified.

A detailed description is now given of a configuration of the fixing roller 41.

The fixing roller 41 is requested to rotate at high speed to improve productivity of the fixing device 40. If the presser 49 contacts the fixing roller 41 while the fixing roller 41 rotates at high speed, the presser 49 degrades rotation of the fixing roller 41, increasing a load torque imposed on the fixing roller 41. Additionally, the presser 49 may shave the outer circumferential surface of the fixing roller 41, degrading durability of the fixing roller 41 and resulting in breakage of the fixing roller 41. To address this circumstance, the presser 49 is requested to be isolated from the fixing roller 41. On the other hand, the presser 49 is requested to be in proximity to the fixing nip N1 to suppress variation in gloss of the toner image T as described above.

If the fixing roller 41 is a hard roller having a hardness greater than a hardness of the pressure roller 45 to allow the pressure roller 45 to deform as the pressure roller 45 is pressed against the fixing roller 41 via the fixing belt 43, a gap provided between the fixing roller 41 and the inner circumferential surface of the fixing belt 43 and situated downstream from the exit N1*e* of the fixing nip N1 in the sheet conveyance direction DP increases gradually from the exit N1*e* of the fixing nip N1 so that the gap has a wedge shape. Accordingly, the gap provided between the fixing roller 41 and the inner circumferential surface of the fixing belt 43 and situated in proximity to the exit N1*e* of the fixing nip N1 is smaller than a thickness of the plate presser 49.

If the presser 49 comes into contact with the outer circumferential surface of the fixing roller 41, the front edge 49*f* of the presser 49 may damage the outer circumferential surface of the fixing roller 41. To address this circumstance, the presser 49 is requested to be isolated from the fixing roller 41. However, the presser 49 is not placed in the wedge-shaped gap provided between the fixing roller 41 and the inner circumferential surface of the fixing belt 43 and is not situated in proximity to the exit N1*e* of the fixing nip N1 because the gap is smaller than the thickness of the plate presser 49. Further, in order to prevent the presser 49 from contacting the fixing roller 41 due to tolerance of parts and assembly errors, the free end of the presser 49 is spaced apart from the exit N1*e* of the fixing nip N1. To address this circumstance, the fixing roller 41 is constructed of a core bar and an elastic layer. A hardness of the fixing roller 41 is smaller than a hardness of the pressure roller 45 so that the elastic layer of the fixing roller 41 is deformed by pressure from the pressure roller 45.

Figure 10:
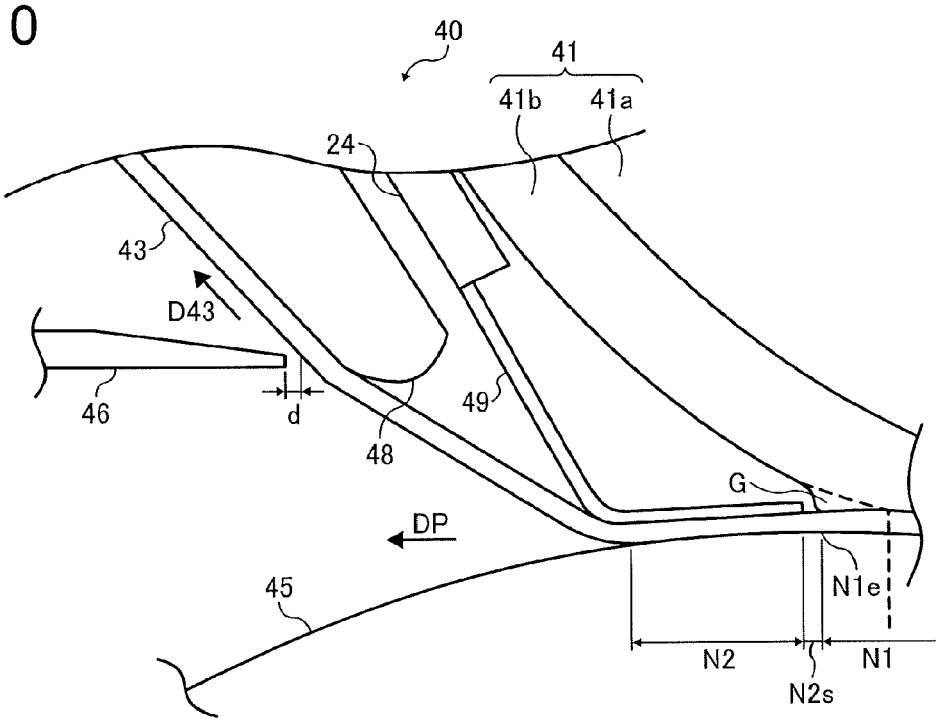
FIG. 10 is a partially enlarged, vertical cross-sectional view of the fixing device depicted in FIG. 2, illustrating components situated in proximity to an exit of a fixing nip and a fixing roller.

FIG. 10 is a partially enlarged, vertical cross-sectional view of the fixing device 40, illustrating components situated in proximity to the exit N1*e* of the fixing nip N1 and the fixing roller 41. As illustrated in FIG. 10, the fixing roller 41 is constructed of a core bar 41*a* and an elastic layer 41*b* coating the core bar 41*a*. The elastic layer 41*b* is made of silicone rubber having a thickness of about 20 mm. The fixing roller 41 has an Asker C hardness of 42 plus and minus 3 Hs that is smaller than an Asker C hardness of 68 plus and minus 3 Hs of the pressure roller 45.

As the pressure roller 45 is pressed against the fixing roller 41 via the fixing belt 43, the elastic layer 41*b* of the fixing roller 41 is deformed and fills in a wedge-shaped gap G indicated by a dotted line in FIG. 10 and provided between the fixing roller 41 and the fixing belt 43. At the exit N1*e* of the fixing nip N1, the outer circumferential surface of the fixing roller 41 is contoured to bulge sharply from the inner circumferential surface of the fixing belt 43. Accordingly, as illustrated in FIG. 10, the free end of the presser 49 is disposed in proximity to the fixing nip N1 such that the presser 49 is isolated from the outer circumferential surface of the fixing roller 41, thus decreasing the border N2*s*. Consequently, at the border N2*s*, the amount of steam discharged from the sheet P and the amount of thermal expansion of air contained in toner of the toner image T on the sheet P decrease, suppressing generation of air bubbles precisely and suppressing variation in gloss of the toner image T on the sheet P further.

In order to elastically deform the elastic layer 41*b* of the fixing roller 41 precisely, the hardness of the fixing roller 41 is not greater than the hardness of the pressure roller 45. If the hardness of the pressure roller 45 is smaller than the hardness of the fixing roller 41, the pressure roller 45 may deform elastically and may barely exert pressure to the fixing roller 41 that is great enough to deform the elastic layer 41*b* of the fixing roller 41. Accordingly, the outer circumferential surface of the fixing roller 41 at the exit N1*e* of the fixing nip N1 is contoured to separate gradually from the fixing belt 43. The gap between the fixing belt 43 and the fixing roller 41 at the position in proximity to the exit N1*e* of the fixing nip N1 is enlarged gradually from the exit N1*e* of the fixing nip N1 to define the wedge-shaped gap G. Hence, the presser 49 may not be situated in proximity to the fixing nip N1.

According to this exemplary embodiment, the Asker C hardness of 42 plus and minus 3 Hs of the fixing roller 41 is smaller than the Asker C hardness of 68 plus and minus 3 Hs of the pressure roller 45 by about 20 Hs. Since the hardness of the fixing roller 41 is smaller than the hardness of the pressure roller 45, the pressure roller 45 deforms the elastic layer 41*b* of the fixing roller 41 precisely. Accordingly, at the exit N1*e* of the fixing nip N1, the outer circumferential surface of the fixing roller 41 is contoured to bulge sharply from the inner circumferential surface of the fixing belt 43. Thus, the presser 49 is situated in proximity to the fixing nip N1.

If the presser 49 brings the fixing belt 43 into contact with the pressure roller 45 constantly, the presser 49 exerts pressure to the fixing belt 43 and the pressure roller 45 constantly, shortening the life of the fixing belt 43 and the pressure roller 45. Additionally, if the presser 49 brings the fixing belt 43 into contact with the pressure roller 45 when the fixing belt 43 is driven and rotated while no sheet P is conveyed through the fixing device 40, for example, while the fixing device 40 is warmed up, the presser 49 frictionally contacting the inner circumferential surface of the fixing belt 43 may cause the fixing belt 43 to suffer from abrasion earlier. To address this circumstance, while no sheet P is conveyed through the fixing device 40 or while a sheet P, such as thick paper and an OHP transparency, that is not susceptible to waving due to discharging and absorption of steam is conveyed through the fixing device 40, the presser 49 does not bring the fixing belt 43 into contact with the pressure roller 45.

When thick paper is conveyed through the fixing device 40, a leading edge of the thick paper may strike the free end of the presser 49 via the fixing belt 43, bending or directing the free end of the presser 49 downstream in the sheet conveyance direction DP or the fixing belt 43 may be sandwiched between the leading edge of the thick paper and the free end of the presser 49, damaging the fixing belt 43. To address this circumstance, when thick paper is conveyed through the fixing device 40, the presser 49 is situated at an isolation position where the presser 49 isolates the fixing belt 43 from the pressure roller 45.

A description is provided of a construction of a mover 20 that moves the presser 49 between a contact position where the presser 49 brings the fixing belt 43 into contact with the pressure roller 45 and the isolation position where the presser 49 isolates the fixing belt 43 from the pressure roller 45.

Figure 11:
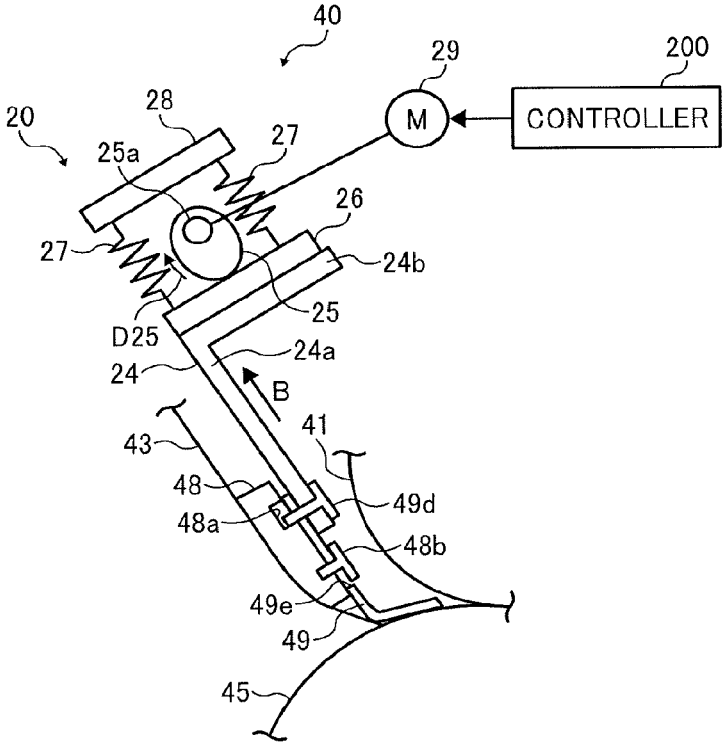
FIG. 11 is a partial schematic vertical cross-sectional view of the fixing device depicted in FIG. 2, illustrating the presser situated at a contact position and a mover that moves the presser.

FIG. 11 is a partial schematic vertical cross-sectional view of the fixing device 40, illustrating the mover 20. As illustrated in FIG. 11, the presser 49 is fastened to the support plate 24 with a step screw 49*d*. The support plate 24 is attached to a side plate of the fixing device 40 such that the support plate 24 is movable in a predetermined range in a direction B. The separation aid 48 is fastened to the presser 49 with a step screw 48*b*. For example, an elongate through hole 49*e* penetrates through the presser 49 and extends in the direction B. The step screw 48*b* is inserted into and secured to the separation aid 48 through the elongate through hole 49*e*. The separation aid 48 includes an opposed face disposed opposite the fixing roller 41 and mounting a clearance groove 48*a* that releases a front end of the step screw 49*d* fastening the presser 49 to the support plate 24. The clearance groove 48*a* extends in the direction B. The step screw 49*d* penetrates through the support plate 24 and the presser 49. The front end of the step screw 49*d* is inside the clearance groove 48*a*.

The support plate 24 includes a base portion 24*a* that is substantially parallel to the fixing belt 43 and a bent portion 24*b* bent relative to the base portion 24*a*. The bent portion 24*b* is disposed opposite the pressure roller 45 via the base portion 24*a* and bent toward the fixing roller 41. A cam contact 26 is mounted on each lateral end of the bent portion 24*b* in the axial direction of the fixing roller 41. The cam contact 26 contacts a cam 25. The cam 25 is interposed between a pair of tension springs 27. One end of each of the tension springs 27 is anchored to the cam contact 26. Another end of each of the tension springs 27 is anchored to a spring support 28. The tension springs 27 bias the support plate 24 in a separation direction in which the support plate 24 separates from the pressure roller 45. The cam 25 is attached to both lateral ends of a driving shaft 25*a* in an axial direction thereof. The driving shaft 25*a* is coupled to a motor 29. The motor 29 is operatively connected to a controller 200 that controls the motor 29. For example, the controller 200 (e.g., a processor) is a central processing unit (CPU) provided with a random-access memory (RAM) and a read-only memory (ROM). The controller 200 may be situated inside the fixing device 40 or the image forming apparatus 1000.

Figure 12:
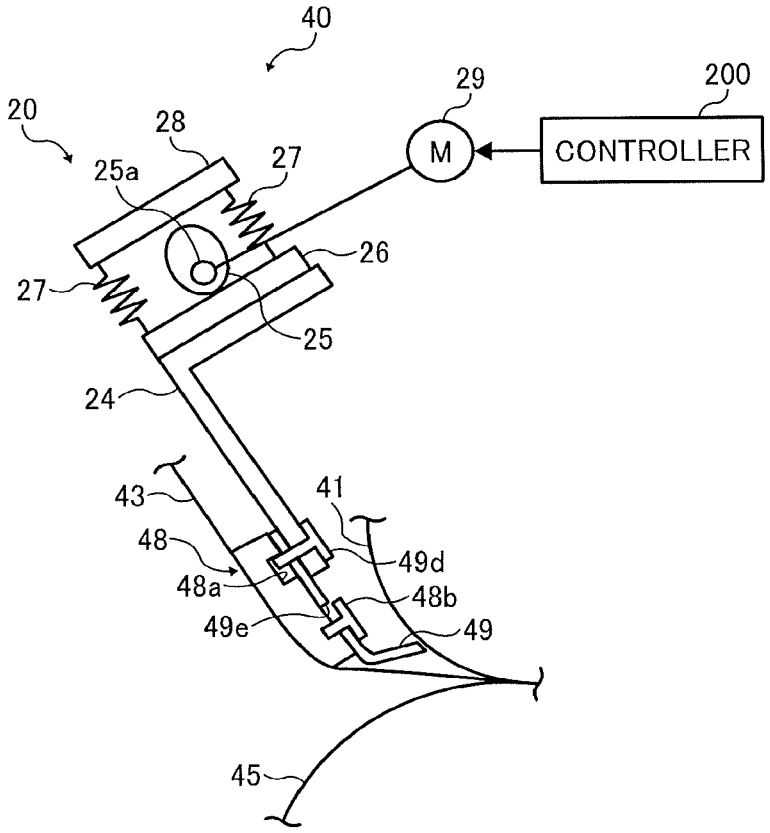
FIG. 12 is a partial vertical cross-sectional view of the fixing device depicted in FIG. 2, illustrating the presser situated at an isolation position.

FIG. 12 is a partial vertical cross-sectional view of the fixing device 40, illustrating the isolation position of the presser 49.

As the controller 200 drives the motor 29 to rotate the cam 25 clockwise in FIG. 11 in a rotation direction D25 from the contact position depicted in FIG. 11, a bias applied by the tension springs 27 moves the support plate 24 and the presser 49 supported by the support plate 24 in the separation direction in which the support plate 24 and the presser 49 separate from the pressure roller 45. The presser 49 moves relative to the separation aid 48 in the direction B in which the presser 49 separates from the pressure roller 45.

As illustrated in FIG. 12, after the cam 25 rotates by 180 degrees from the contact position depicted in FIG. 11, the presser 49 reaches the isolation position. Thus, the presser 49 isolates the fixing belt 43 from the pressure roller 45, eliminating the post nip N2.

A description is provided of one example of a control method for moving the presser 49.

Figure 13:
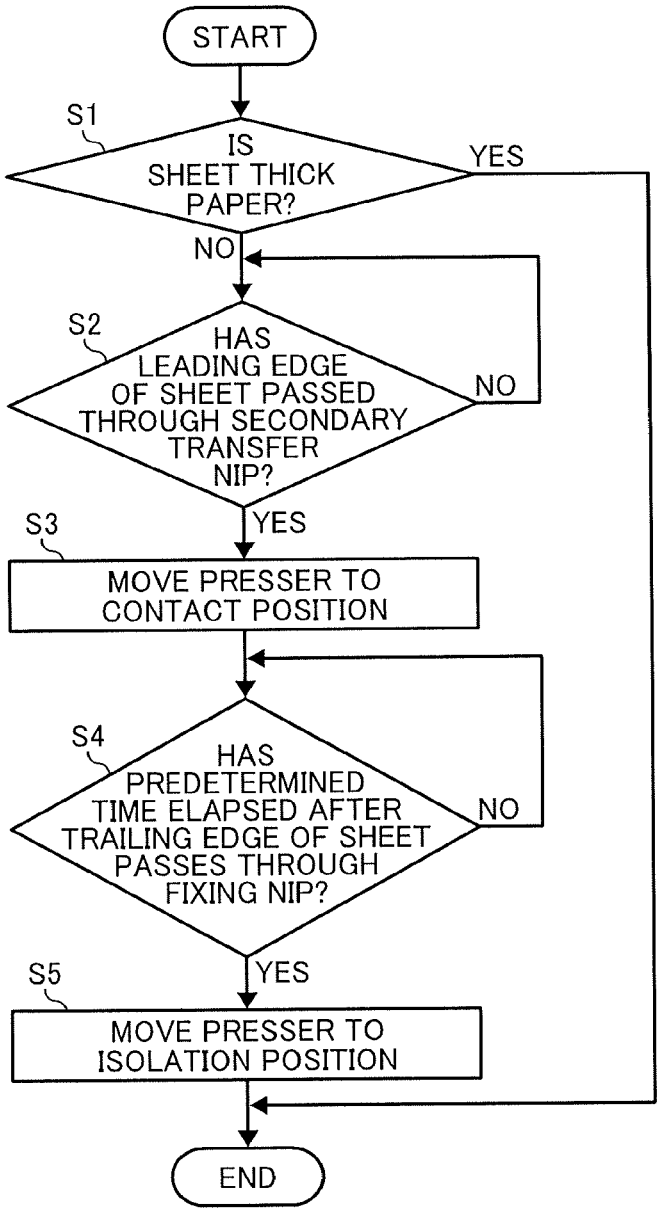
FIG. 13 is a flowchart illustrating control processes of a control method for moving the presser depicted in FIGS. 11 and 12.

FIG. 13 is a flowchart illustrating control processes of the control method for moving the presser 49.

As an image forming operation of the image forming apparatus 1000 depicted in FIG. 1 starts, the controller 200 depicted in FIG. 11 determines whether a sheet P to be conveyed through the fixing device 40 is thick paper or not in step S1. According to this exemplary embodiment, a sheet P having a paper weight not smaller than 200 [g/m$^2$] is defined as thick paper.

If the controller 200 determines that the sheet P to be conveyed through the fixing device 40 is not thick paper (NO in step S1), the controller 200 determines whether or not a leading edge of the sheet P has passed through the secondary transfer nip formed between the intermediate transfer belt 61 and the secondary transfer belt 77 depicted in FIG. 1 in step S2.

If the controller 200 determines that the leading edge of the sheet P has passed through the secondary transfer nip (YES in step S2), the controller 200 drives the motor 29 to cause the mover 20 to move the presser 49 from the isolation position depicted in FIG. 12 to the contact position depicted in FIG. 11 in step S3.

For example, when a predetermined time has elapsed after the registration roller pair 34 depicted in FIG. 1 starts rotation, the mover 20 starts moving the presser 49 from the isolation position depicted in FIG. 12 to the contact position depicted in FIG. 11. According to this exemplary embodiment, when the leading edge of the sheet P has passed through the secondary transfer nip, the mover 20 moves the presser 49 from the isolation position depicted in FIG. 12 to the contact position depicted in FIG. 11. Alternatively, the mover 20 may move the presser 49 to the contact position depicted in FIG. 11 at other time as long as the mover 20 finishes moving the presser 49 to the contact position before the leading edge of the sheet P enters the fixing nip N1. However, in order to decrease a load imposed on the fixing belt 43 and the pressure roller 45, the mover 20 preferably starts moving the presser 49 at a time when the presser 49 has reached the contact position immediately before the leading edge of the sheet P enters the fixing nip N1.

As described above, in a transfer process when the toner image T is transferred onto the sheet P, that is, an image forming process immediately before the sheet P is conveyed through the fixing device 40, the mover 20 starts moving the presser 49 from the isolation position depicted in FIG. 12 to the contact position depicted in FIG. 11. Accordingly, immediately before the sheet P is conveyed through the fixing device 40, the mover 20 halts the presser 49 at the contact position depicted in FIG. 11. Thus, the presser 49 does not exert pressure to the fixing belt 43 and the pressure roller 45 unnecessarily and thereby does not impose a load to the fixing belt 43 and the pressure roller 45. Additionally, the presser 49 does not frictionally contact the fixing belt 43, preventing abrasion of the inner circumferential surface of the fixing belt 43.

In step S4, the controller 200 determines whether or not a predetermined time has elapsed after a trailing edge of the sheet P passes through the fixing nip N1.

If the controller 200 determines that the predetermined time has elapsed after the trailing edge of the sheet P passes through the fixing nip N1 (YES in step S4), the controller 200 drives the motor 29 to cause the mover 20 to move the presser 49 from the contact position depicted in FIG. 11 to the isolation position depicted in FIG. 12 in step S5.

As one example, when the ejection sensor described above detects the trailing edge of the sheet P, the mover 20 starts moving the presser 49 to the isolation position depicted in FIG. 12. At a predetermined time when the trailing edge of the sheet P has passed through the fixing device 40, the mover 20 moves the presser 49 from the contact position depicted in FIG. 11 to the isolation position depicted in FIG. 12. However, in order to decrease the load (e.g., abrasion) imposed on the fixing belt 43 and the pressure roller 45, the mover 20 preferably starts moving the presser 49 to the isolation position depicted in FIG. 12 immediately after the trailing edge of the sheet P passes through the fixing device 40.

Since the mover 20 starts moving the presser 49 to the isolation position depicted in FIG. 12 immediately after the trailing edge of the sheet P passes through the fixing device 40, the presser 49 does not exert pressure to the fixing belt 43 and the pressure roller 45 unnecessarily and does not impose the load to the fixing belt 43 and the pressure roller 45. Additionally, the presser 49 does not frictionally contact the fixing belt 43, preventing abrasion of the inner circumferential surface of the fixing belt 43.

If the sheet P conveyed toward the fixing nip N1 is thick paper that is not susceptible to waving (YES in step S1), the mover 20 does not move the presser 49 to the contact position depicted in FIG. 11 and retains the presser 49 at the isolation position depicted in FIG. 12. Accordingly, the presser 49 reduces the load imposed on the fixing belt 43 and the pressure roller 45, improving durability of the fixing belt 43 and the pressure roller 45. Additionally, the presser 49 decreases friction between the presser 49 and the fixing belt 43. For example, according to this exemplary embodiment, the presser 49 situated at the isolation position depicted in FIG. 12 is isolated from the inner circumferential surface of the fixing belt 43. Accordingly, the presser 49 situated at the isolation position depicted in FIG. 12 does not generate friction between the presser 49 and the inner circumferential surface of the fixing belt 43, suppressing abrasion of the fixing belt 43 further.

For example, when the thick paper used as the sheet P is conveyed through the fixing device 40, the presser 49 situated at the isolation position depicted in FIG. 12 prevents the leading edge of the thick paper in the sheet conveyance direction DP from striking the free end of the presser 49, extending the life of the fixing belt 43 and the presser 49.

The control method described above is one example. The amount of steam generated from the sheet P may increase according to a fixing condition and the type of paper used as the sheet P, thus waving the sheet P. To address this circumstance, according to the type of the sheet P, for example, if the sheet P has a paper weight not smaller than 120 [g/m$^2$], the mover 20 may cause the presser 49 to isolate the fixing belt 43 from the pressure roller 45. Conversely, if the sheet P has a paper weight smaller than 120 [g/m$^2$], the mover 20 may cause the presser 49 to bring the fixing belt 43 into contact with the pressure roller 45.

A description is provided of a construction of a mover 20*a* as a first variation of the mover 20 depicted in FIGS. 11 and 12.

Figure 14:
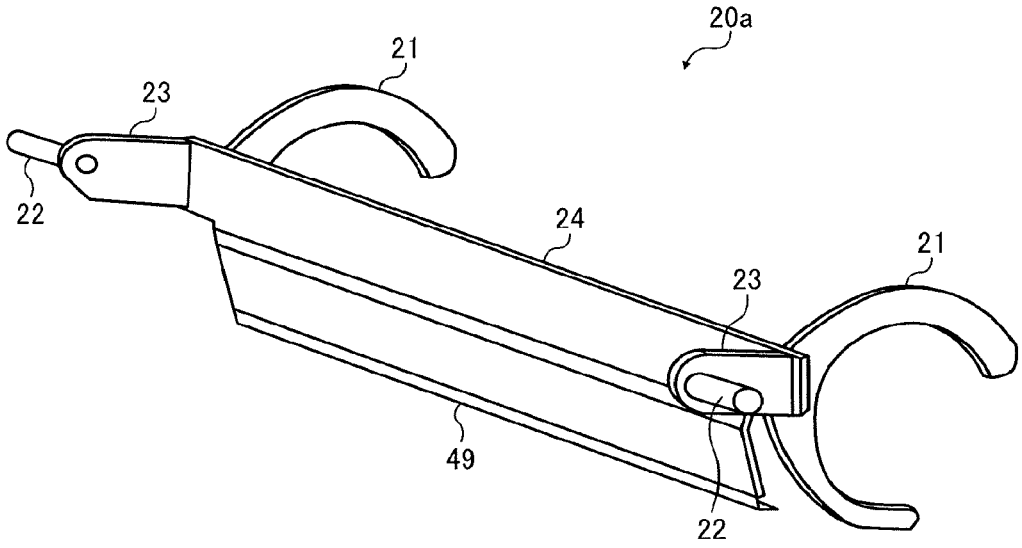
FIG. 14 is a perspective view of a mover as a first variation of the mover depicted in FIG. 11.

FIG. 14 is a perspective view of the mover 20*a*. As illustrated in FIG. 14, the mover 20*a* includes the bent support plate 24 that mounts and supports the presser 49. The presser 49 is fastened to a lower end in FIG. 14 of the support plate 24, that is, an upstream end of the support plate 24 in the rotation direction D43 of the fixing belt 43, with a screw. An arm 23 and a guide 21 are disposed at each lateral end of the support plate 24 in the axial direction of the fixing roller 41. A coupler 22 is secured to a tip portion of the arm 23 and is coupled to a driver including a cam. The coupler 22 is inserted into and supported by an arcuate, elongate hole disposed on the side face of the frame of the fixing device 40. The elongate hole causes the coupler 22 to pivot about a rotation axis of the fixing roller 41. A spring is anchored to the coupler 22 to bias the presser 49 supported by the support plate 24 against the pressure roller 45.

Figure 15:
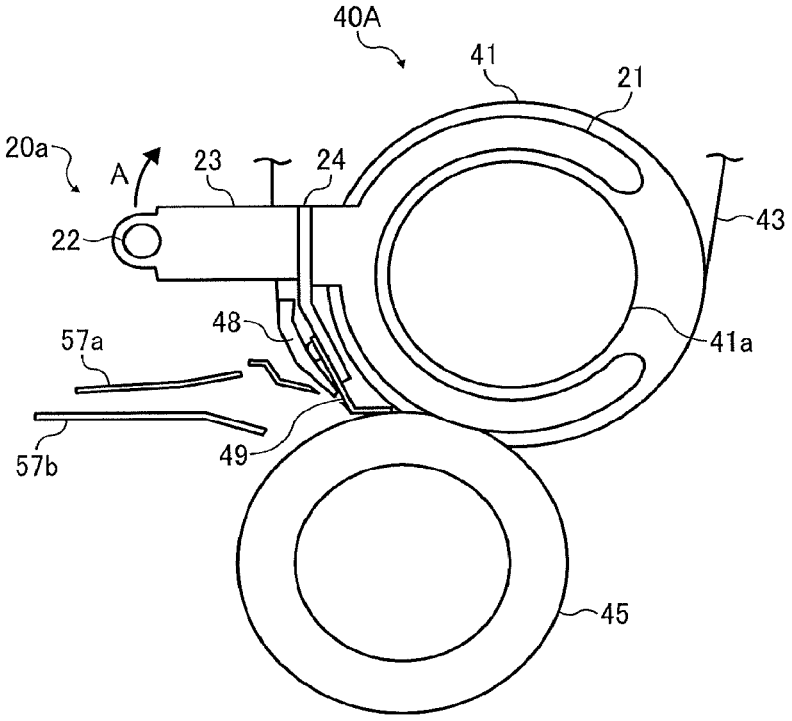
FIG. 15 is a partial vertical cross-sectional view of a fixing device incorporating the mover depicted in FIG. 14, illustrating the presser situated at the contact position.
Figure 16:
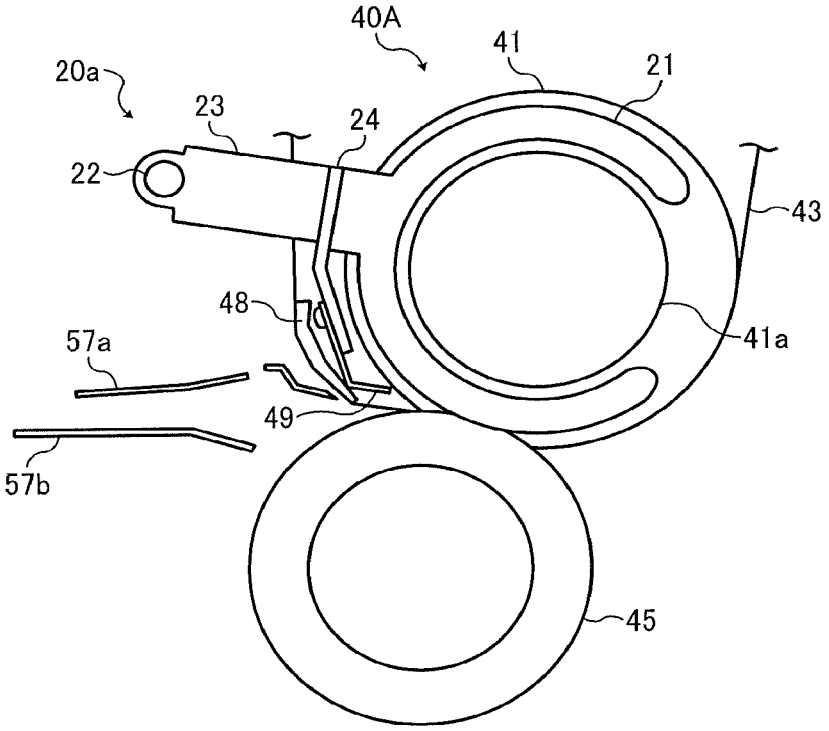
FIG. 16 is a partial vertical cross-sectional view of the fixing device incorporating the mover depicted in FIG. 14, illustrating the presser situated at the isolation position.

FIG. 15 is a partial vertical cross-sectional view of a fixing device 40A incorporating the mover 20*a*, illustrating the contact position of the presser 49 moved by the mover 20*a*. FIG. 16 is a partial vertical cross-sectional view of the fixing device 40A, illustrating the isolation position of the presser 49 moved by the mover 20*a*.

As illustrated in FIGS. 15 and 16, the guide 21 is attached to the core bar 41*a* of the fixing roller 41. In order to move the presser 49 to the isolation position depicted in FIG. 16, the controller 200 rotates the cam of the driver to press the coupler 22 upward in FIG. 15 against a bias exerted by the spring. The mover 20*a* pivots about the rotation axis of the fixing roller 41 in a pivot direction A while the mover 20*a* is guided by the guide 21. As illustrated in FIG. 16, the presser 49 moves to the isolation position where the presser 49 is isolated from the fixing belt 43.

The mover 20*a* pivots the support plate 24 supporting the presser 49 about the rotation axis of the fixing roller 41, thus moving the presser 49 between the contact position depicted in FIG. 15 and the isolation position depicted in FIG. 16. Accordingly, the presser 49 moves between the contact position depicted in FIG. 15 and the isolation position depicted in FIG. 16 such that the presser 49 moves on an arcuate trajectory along the outer circumferential surface of the fixing roller 41. Consequently, even if the front edge 49*f* of the pressing portion 49*b* of the presser 49 is disposed in proximity to the fixing roller 41 as illustrated in FIG. 5, the front edge 49*f* does not contact the outer circumferential surface of the fixing roller 41 while the presser 49 moves to the isolation position depicted in FIG. 16. Thus, the presser 49 does not damage the outer circumferential surface of the fixing roller 41.

If the cam of the driver is configured to contact the coupler 22 directly, the cam may overlap a sheet conveyance region enclosed by an upper ejection guide 57*a* and a lower ejection guide 57*b* depicted in FIG. 15 that are disposed downstream from the exit N1*e* of the fixing nip N1 in the sheet conveyance direction DP. In this case, the cam contacting one end of the coupler 22 in the axial direction of the fixing roller 41 and the cam contacting another end of the coupler 22 in the axial direction of the fixing roller 41 are attached to a rotation shaft that crosses the sheet conveyance region defined by the upper ejection guide 57*a* and the lower ejection guide 57*b*. Accordingly, the sheet P having passed through the post nip N2 may be caught by the rotation shaft and may not be conveyed properly. To address this circumstance, the cam contacting one end of the coupler 22 in the axial direction of the fixing roller 41 and the cam contacting another end of the coupler 22 in the axial direction of the fixing roller 41 may be driven by separate driving motors, respectively, increasing manufacturing costs of the fixing device 40A. Hence, in order to prevent the cam in direct contact with the coupler 22 from crossing the sheet conveyance region defined by the upper ejection guide 57*a* and the lower ejection guide 57*b*, the fixing device 40A may include a joint that couples the cam with the coupler 22 to place the cam outside the sheet conveyance region defined by the upper ejection guide 57*a* and the lower ejection guide 57*b*.

Figure 17:
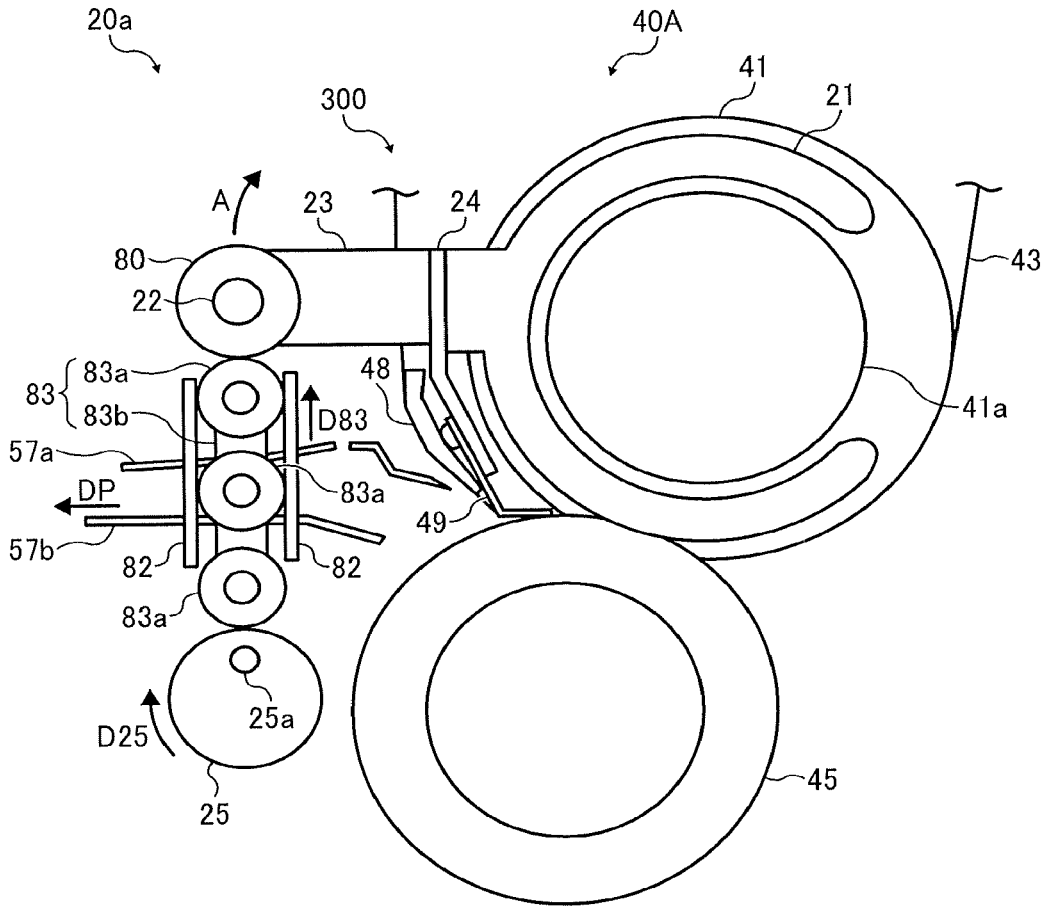
FIG. 17 is a schematic vertical cross-sectional view of the fixing device depicted in FIG. 15, illustrating a joint of the mover.
Figure 18:
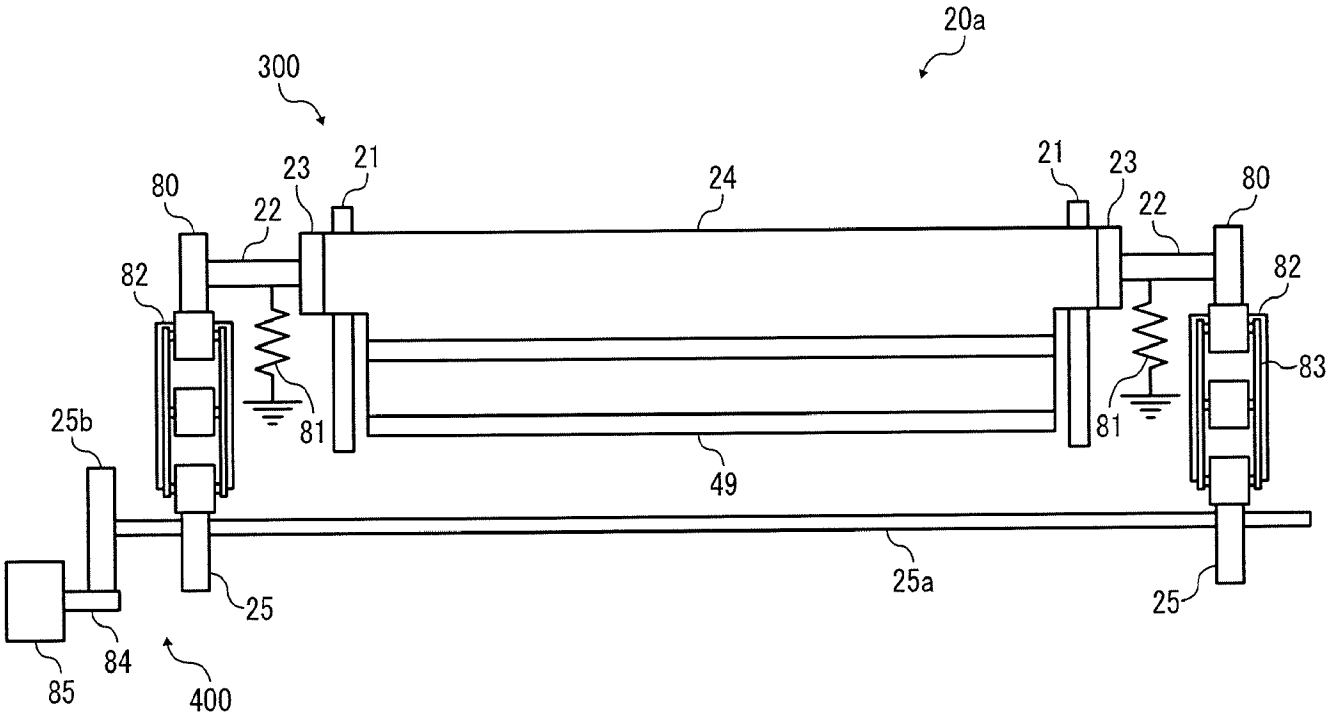
FIG. 18 is a schematic side view of the mover depicted in FIG. 17.

FIG. 17 is a schematic vertical cross-sectional view of the fixing device 40A, illustrating the mover 20*a* including a joint 83. FIG. 18 is a schematic side view of the mover 20*a* depicted in FIG. 17, seen from a downstream position disposed downstream from the mover 20*a* in the sheet conveyance direction DP.

As illustrated in FIG. 17, a cam 25 serving as a driving portion is disposed opposite the pressure roller 45 and disposed opposite the coupler 22 via the sheet conveyance region defined by the upper ejection guide 57*a* and the lower ejection guide 57*b*. The coupler 22 is attached with a driving force receiver 80 that contacts the joint 83 and receives a driving force from the cam 25.

The joint 83 includes three guide rollers 83*a* aligned in a direction perpendicular to the axial direction of the fixing roller 41 and the sheet conveyance direction DP with an identical gap between the adjacent guide rollers 83*a*. The guide rollers 83*a* are rotatably supported by a pair of roller support plates 83*b*. One of the three guide rollers 83*a* that is disposed opposite the coupler 22 contacts the driving force receiver 80 attached to the coupler 22. Another one of the three guide rollers 83*a* that is disposed opposite the cam 25 contacts the cam 25.

A pair of guide plates 82 guides the joint 83 vertically in FIG. 17. The three guide rollers 83*a* contact the pair of guide plates 82. As illustrated in FIG. 18, the cam 25 is mounted on each lateral end of the driving shaft 25*a* in the axial direction thereof. A gear 25*b* is mounted on a left lateral end of the driving shaft 25*a* in FIG. 18, which is situated at a rear end of the fixing device 40A. The gear 25*b* meshes with a motor gear 84 mounted on a driving motor 85. One end of a spring 81 is anchored to the coupler 22. The spring 81 biases the coupler 22 toward the cam 25.

The joint 83 places the cam 25, serving as the driving portion, outside the sheet conveyance region defined by the upper ejection guide 57*a* and the lower ejection guide 57*b*, allowing the cam 25 to be mounted on each lateral end of the single driving shaft 25*a* in the axial direction thereof. Since the single driving shaft 25*a* mounts the two cams 25 at both lateral ends of the driving shaft 25*a* in the axial direction thereof, respectively, the single driving motor 85 coupled to one lateral end of the driving shaft 25*a* in the axial direction thereof drives the two cams 25. Accordingly, compared to a configuration in which separate driving motors drive the two cams 25, respectively, the driving motor 85 reduces the number of parts of the fixing device 40A. Additionally, the single driving shaft 25*a* mounting the cams 25 at both lateral ends of the driving shaft 25*a* in the axial direction thereof, respectively, drives and rotates the cams 25 simultaneously, suppressing warping of the support plate 24.

The cams 25 mounted on both lateral ends of the driving shaft 25*a* in the axial direction thereof lift the couplers 22 disposed opposite both lateral ends of the support plate 24 in a longitudinal direction thereof, respectively. Hence, the cams 25 suppress warping of the support plate 24 compared to a configuration in which the cam 25 is mounted on one lateral end of the driving shaft 25*a* in the axial direction thereof such that the cam 25 lifts the coupler 22 disposed opposite one lateral end of the support plate 24 in the longitudinal direction thereof.

When the presser 49 moves from the contact position depicted in FIG. 17 to the isolation position, the controller 200 depicted in FIG. 11 drives the driving motor 85 to rotate the cams 25 in the rotation direction D25. The cams 25 lift the joints 83, respectively, in a direction D83 depicted in FIG. 17. Each of the joints 83 includes the plurality of guide rollers 83*a*. As the guide rollers 83*a* roll or slide over a surface of each of the guide plates 82, the joints 83 move in the direction D83. Thus, while each of the joints 83 is guided by the guide plates 82, each of the joints 83 moves smoothly in the direction D83.

Figure 19:
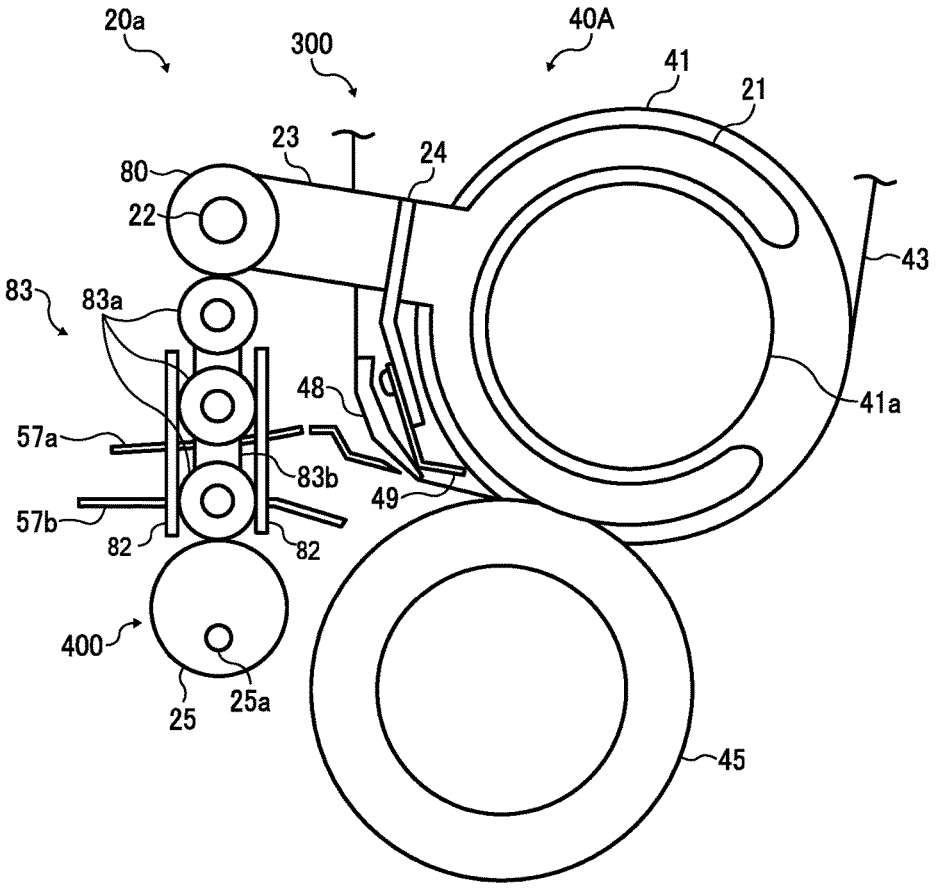
FIG. 19 is a schematic vertical cross-sectional view of the fixing device depicted in FIG. 17, illustrating the presser situated at the isolation position.

As the joints 83 move in the direction D83, each of the joints 83 lifts the driving force receiver 80 against a bias exerted by the spring 81. The support plate 24 supporting the presser 49 pivots about the rotation axis of the fixing roller 41 in a pivot direction A while the support plate 24 is guided by the guide 21. Accordingly, as described above, the presser 49 moves to the isolation position depicted in FIG. 19 such that the presser 49 moves on the arcuate trajectory along the outer circumferential surface of the fixing roller 41. FIG. 19 is a schematic vertical cross-sectional view of the fixing device 40A, illustrating the isolation position of the presser 49.

As illustrated in FIG. 19, the mover 20*a* includes the arm 23 extending in a separation direction in which the arm 23 separates from the fixing roller 41. The tip portion of the arm 23 mounts the coupler 22 that receives a driving force transmitted from the cam 25. The coupler 22 is disposed outside the loop formed by the fixing belt 43. Compared to a configuration in which the coupler 22, that receives the driving force transmitted from the cam 25 directly or indirectly through the joint 83, is disposed inside the loop formed by the fixing belt 43, the coupler 22 disposed outside the loop formed by the fixing belt 43 is isolated from the fixing roller 41 with an increased interval therebetween.

The coupler 22 spaced apart from the fixing roller 41 attains advantages below. First, the coupler 22 suppresses deviation of the contact position and the isolation position of the presser 49 due to manufacturing error and assembly error. The mover 20*a* includes a support 300 constructed of the guide 21, the coupler 22, the arm, 23, and the support plate 24. The support 300 supports the presser 49. As the support 300 pivots about the rotation axis of the fixing roller 41, the support 300 moves the presser 49. An amount of movement of the presser 49 moved by the support 300 pivoting about the rotation axis of the fixing roller 41 by an angle θ increases as the coupler 22 separates from the rotation axis of the fixing roller 41 farther. When the coupler 22 that receives the driving force transmitted from the cam 25 directly or indirectly through the joint 83 is shifted due to manufacturing error or assembly error, an amount of shifting of the presser 49 affected by an amount of shifting of the coupler 22 decreases as the coupler 22 separates from the fixing roller 41 farther. Accordingly, compared to the configuration in which the coupler 22 is disposed inside the loop formed by the fixing belt 43, the coupler 22 disposed outside the loop formed by the fixing belt 43 reduces influence that shifting of the coupler 22 caused by manufacturing error or assembly error exerts on the contact position and the isolation position of the presser 49.

A side plate of the fixing device 40A is provided with a slot through which the coupler 22 penetrates. The slot supports the coupler 22 such that the coupler 22 is rotatable about the rotation axis of the fixing roller 41. The side plate of the fixing device 40A is further provided with a slot through which the driving shaft 25*a* penetrates such that the driving shaft 25*a* is supported by the slot and rotatable. If the fixing device 40A incorporates the mover 20*a* as illustrated in FIGS. 17 to 19, the side plate of the fixing device 40A is further provided with a slot that supports the guide plates 82 and the joint 83. The side plate of the fixing device 40A is further provided with a slot that supports the pressure roller 45 such that the pressure roller 45 comes into contact with and separates from the fixing belt 43. The side plate of the fixing device 40A is further provided with a slot that rotatably supports the fixing roller 41. Accordingly, if the coupler 22 is disposed inside the loop formed by the fixing belt 43, the slot supporting the coupler 22, the slot supporting the driving shaft 25*a*, and the slot supporting the guide plates 82 and the joint 83 are situated in proximity to the slot supporting the fixing roller 41 and the slot supporting the pressure roller 45. Consequently, the strength of the side plate may degrade, resulting in deformation of the side plate. If the side plate deforms, the rotation axis of each of the fixing roller 41 and the pressure roller 45 may tilt.

Conversely, if the coupler 22 is disposed outside the loop formed by the fixing belt 43, the slot supporting the coupler 22, the slot supporting the driving shaft 25*a*, and the slot supporting the guide plates 82 and the joint 83 are spaced apart from the slot supporting the fixing roller 41 and the slot supporting the pressure roller 45, suppressing degradation in the strength of the side plate. Thus, deformation of the side plate is suppressed, preventing the rotation axis of each of the fixing roller 41 and the pressure roller 45 from tilting.

The coupler 22 disposed outside the loop formed by the fixing belt 43 separates the spring 81 from a center of the fixing roller 41 in the axial direction thereof. The presser 49 is deformed resiliently and situated at the contact position. Accordingly, when the presser 49 is at the contact position, a restoring force of the presser 49 exerts a bias to the support 300 constructed of the guide 21, the coupler 22, the arm, 23, and the support plate 24. The bias pivots the support 300 in the pivot direction A depicted in FIGS. 15 and 17. The spring 81 biases the support 300 in a reverse direction opposite the pivot direction A depicted in FIGS. 15 and 17 to prevent the support 300 from being pivoted by the restoring force of the presser 49.

As indicated by a relation between moments of forces, as the coupler 22 separates farther from the rotation axis of the fixing roller 41 about which the support 300 pivots, a bias of the spring 81 that prevents the support 300 from being pivoted by the restoring force of the presser 49 in the pivot direction A decreases. Hence, compared to the configuration in which the coupler 22 is disposed inside the loop formed by the fixing belt 43, the coupler 22 disposed outside the loop formed by the fixing belt 43 decreases the bias of the spring 81. Accordingly, compared to the configuration in which the coupler 22 is disposed inside the loop formed by the fixing belt 43, the coupler 22 disposed outside the loop formed by the fixing belt 43 decreases a torque that moves the presser 49 from the contact position to the isolation position against the bias of the spring 81. Consequently, a downsized motor manufactured at reduced costs to attain a decreased output is employed as the driving motor 85.

A description is provided of a construction of a mover 20*b* as a second variation of the mover 20 depicted in FIGS. 11 and 12.

Figure 20:
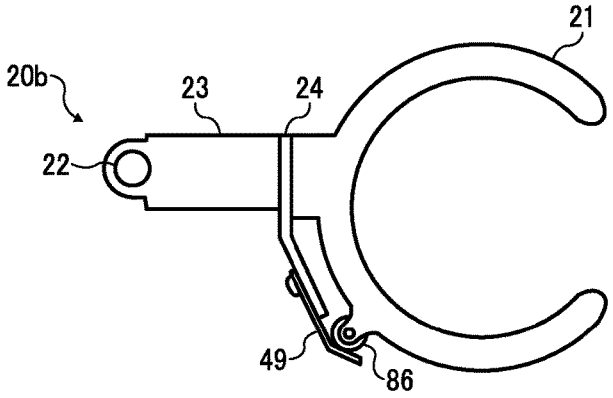
FIG. 20 is a partial schematic cross-sectional view of a mover as a second variation of the mover depicted in FIG. 11.
Figure 21:
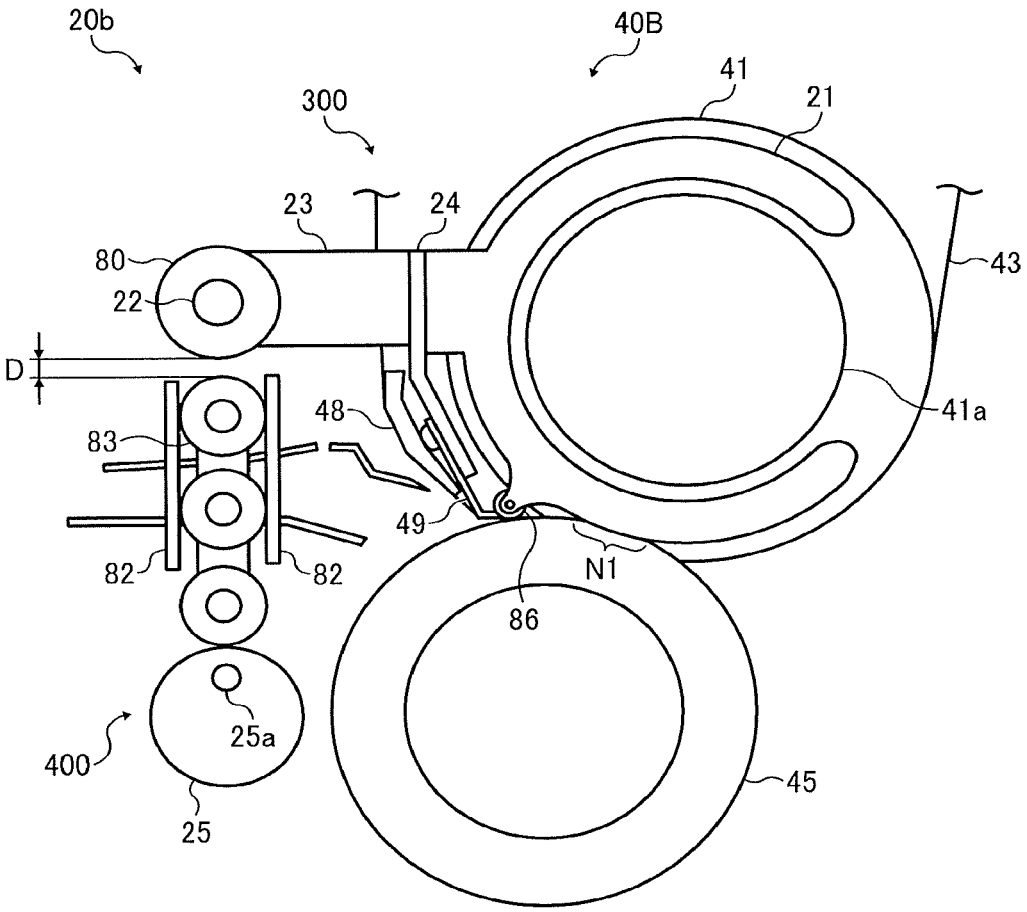
FIG. 21 is a partial schematic cross-sectional view of a fixing device incorporating the mover depicted in FIG. 20.

FIG. 20 is a partial schematic cross-sectional view of the mover 20*b*. FIG. 21 is a partial schematic cross-sectional view of a fixing device 40B incorporating the mover 20*b*, illustrating peripheral components of the fixing nip N1.

As illustrated in FIG. 21, the mover 20*b* includes a positioning roller 86 serving as a positioner that positions the presser 49 at the contact position. The positioning roller 86 is rotatably attached to the guide 21 disposed opposite each lateral end of the presser 49 in a longitudinal direction of the presser 49. As illustrated in FIG. 20, while the presser 49 is imposed with no load, the presser 49 projects beyond the positioning roller 86 radially. The positioning roller 86 is disposed outboard from the presser 49 in the longitudinal direction thereof and a conveyance span of the fixing belt 43 in the axial direction thereof where the sheet P is conveyed over the fixing belt 43. For example, the conveyance span corresponds to a width of a maximum size sheet in the axial direction of the fixing belt 43, which is available in the fixing device 40B.

Figure 22:
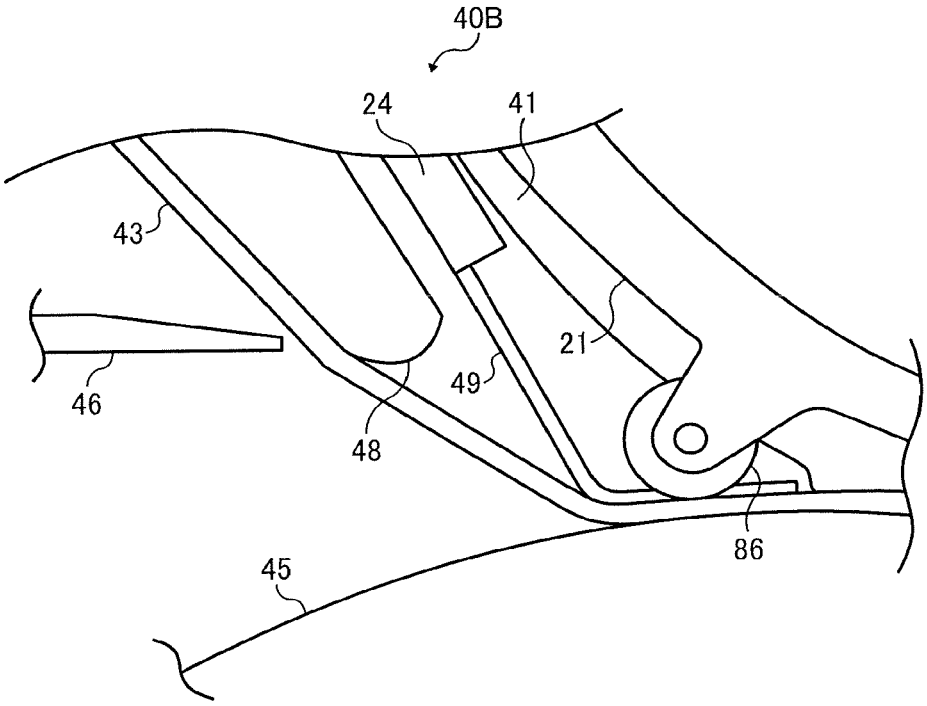
FIG. 22 is a partially enlarged cross-sectional view of the fixing device depicted in FIG. 21.

FIG. 22 is a partially enlarged cross-sectional view of the fixing device 40B incorporating the mover 20*b*, illustrating the peripheral components of the fixing nip N1. As illustrated in FIG. 22, as the positioning roller 86 presses against the pressure roller 45 via the fixing belt 43, the positioning roller 86 positions the presser 49 at the contact position. Thus, the presser 49 presses the fixing belt 43 against the pressure roller 45 with predetermined pressure. Accordingly, the presser 49 suppresses waving of the sheet P precisely and reduces the load imposed on the fixing belt 43 and the pressure roller 45.

Additionally, since the positioning roller 86 is rotatable, the positioning roller 86 slides over the inner circumferential surface of the fixing belt 43 with a reduced resistance, that is, a reduced friction, suppressing abrasion of the fixing belt 43.

As described above, since the presser 49 projects beyond the positioning roller 86 radially while the presser 49 is imposed with no load, the presser 49 comes into contact with the fixing belt 43 to press the fixing belt 43 against the pressure roller 45 before the positioning roller 86 comes into contact with the fixing belt 43. As the presser 49 deforms resiliently, the positioning roller 86 presses against the pressure roller 45 via the fixing belt 43 and positions the presser 49 at the contact position. Pressure with which the positioning roller 86 presses against the pressure roller 45 via the fixing belt 43 is smaller than pressure with which the presser 49 presses against the pressure roller 45 via the fixing belt 43. A pressing area in which the tubular positioning roller 86 presses against the pressure roller 45 via the fixing belt 43 is smaller than a pressing area in which the plate presser 49 presses against the pressure roller 45 via the fixing belt 43. Accordingly, if the positioning roller 86 is disposed within the conveyance span of the fixing belt 43 in the axial direction thereof where the sheet P is conveyed over the fixing belt 43, the positioning roller 86 may not precisely press the sheet P against the pressure roller 45 in an opposed span of the sheet P in the axial direction of the fixing belt 43, that is disposed opposite the positioning roller 86, thus waving the sheet P in the opposed span of the sheet P.

Since the positioning roller 86 is tubular, the positioning roller 86 presses against the pressure roller 45 via the fixing belt 43 at a pressing position separated from the fixing nip N1 farther than a pressing position where the plate presser 49 presses against the pressure roller 45 via the fixing belt 43, thus increasing the border N2*s*. Accordingly, if the positioning roller 86 is disposed within the conveyance span of the fixing belt 43 in the axial direction thereof where the sheet P is conveyed over the fixing belt 43, variation in gloss of the toner image T on the sheet P may occur in the opposed span of the sheet P in the axial direction of the fixing belt 43, that is disposed opposite the positioning roller 86.

To address this circumstance, according to this exemplary embodiment of the fixing device 40B, the positioning roller 86 is disposed outboard from the conveyance span of the fixing belt 43 in the axial direction thereof where the sheet P is conveyed over the fixing belt 43. Thus, the presser 49 presses the sheet P against the pressure roller 45 in an entire span of the sheet P in the axial direction of the fixing belt 43, suppressing waving of the sheet P precisely. In the conveyance span of the fixing belt 43 in the axial direction thereof where the sheet P is conveyed over the fixing belt 43, the positioning roller 86 decreases the border N2*s* in the sheet conveyance direction DP, suppressing variation in gloss of the toner image T on the sheet P.

Since a width of the fixing belt 43 is greater than a width of the pressure roller 45 in the axial direction of the fixing belt 43, the positioning roller 86 presses against the pressure roller 45 indirectly via the fixing belt 43. Alternatively, the positioning roller 86 may press against the pressure roller 45 directly. However, the positioning roller 86 pressing against the pressure roller 45 via the fixing belt 43 attains advantages below. If the positioning roller 86 contacts the pressure roller 45 directly, the presser 49 may deform resiliently while the fixing belt 43 rotates, rendering the fixing belt 43 to flap. Accordingly, the presser 49 may not keep pressing the fixing belt 43 against the pressure roller 45.

Conversely, if the positioning roller 86 presses against the pressure roller 45 via the fixing belt 43, the positioning roller 86 is to be lifted to flap the fixing belt 43. In order to lift the positioning roller 86, the support 300 constructed of the guide 21, the coupler 22, the arm, 23, and the support plate 24 is to be pivoted against the bias exerted by the spring 81. As described above, the spring 81 biases the support 300 in the reverse direction opposite the pivot direction A depicted in FIGS. 15 and 17 to prevent the support 300 from being pivoted by the restoring force of the presser 49. Hence, pressure greater than pressure that deforms the presser 49 resiliently is to be exerted to the positioning roller 86 to lift the positioning roller 86. Accordingly, compared to the positioning roller 86 pressing against the pressure roller 45 directly, the positioning roller 86 pressing against the pressure roller 45 via the fixing belt 43 suppresses flapping of the fixing belt 43 more effectively.

When the positioning roller 86 positions the presser 49 at the contact position as illustrated in FIG. 21, the joint 83 separates from the driving force receiver 80 with an interval D between the joint 83 and the driving force receiver 80. Accordingly, even with slight manufacturing error or slight assembly error, the mover 20*b* presses the positioning roller 86 against the pressure roller 45 precisely, thus positioning the presser 49 at the contact position properly.

According to the exemplary embodiment of the fixing device 40B depicted in FIGS. 20 to 22, the presser 49 presses the fixing belt 43 against the pressure roller 45. Alternatively, as described above, the presser 49 may press the fixing belt 43 toward the pressure roller 45 such that the fixing belt 43 is in proximity to the pressure roller 45 with a slight interval between the fixing belt 43 and the pressure roller 45. In this case, the positioning roller 86 projects beyond the presser 49 radially.

The above describes the exemplary embodiments of the fixing devices 40, 40S, 401, 40A, and 40B installed in the image forming apparatus 1000 such as a copier, a printer, a facsimile machine, and an MFP that forms a toner image T on a sheet P by electrophotography. Alternatively, the exemplary embodiments of the fixing devices 40, 40S, 401, 40A, and 40B may be applied to a fixing device that dries an ink image formed on a sheet with ink and is installed in an image forming apparatus such as a copier, a printer, a facsimile machine, and an MFP that forms an ink image on a sheet by an inkjet printing system, for example.

The exemplary embodiments described above are one example of a fixing device (e.g., the fixing devices 40, 40S, 40T, 40A, and 40B) and attain advantages below in a plurality of aspects 1 to 15.

A description is provided of advantages of the fixing device in the aspect 1.

As illustrated in FIGS. 2, 6, 7, 11, 15, and 21, the fixing device includes a fixing belt (e.g., the fixing belt 43), a nip former (e.g., the fixing roller 41), a pressure rotator (e.g., the pressure roller 45), a heater (e.g., the heater 44), a presser (e.g., the pressers 49, 49S, and 49T), and a mover (e.g., the movers 20, 20*a*, and 20*b*).

The fixing belt 43 is an endless belt stretched taut across a plurality of stretchers. The fixing roller 41 serves as a nip former and one of the plurality of stretchers that stretches the fixing belt. The pressure roller 45 serves as a pressure rotator disposed opposite the nip former via the fixing belt and pressed against the nip former via the fixing belt to form a fixing nip (e.g., the fixing nip N1) between the fixing belt and the pressure rotator. A recording medium (e.g., a sheet P) is conveyed through the fixing nip. The heater 44 serves as a heater that heats the fixing belt. Each of the pressers 49, 49S, and 49T serves as a presser disposed downstream from an exit (e.g., the exit N1*e*) of the fixing nip in a rotation direction (e.g., the rotation direction D43) of the fixing belt. The presser brings the fixing belt into contact with the pressure rotator or presses the fixing belt against the pressure rotator. The mover, coupled to the presser, moves the presser between a contact position where the presser brings the fixing belt into contact with the pressure rotator or presses the fixing belt against the pressure rotator and an isolation position where the presser isolates the fixing belt from the pressure rotator.

A description is provided of a construction of a comparative fixing device.

The comparative fixing device includes a fixing belt stretched taut across a plurality of stretchers and heated by a heater. A pressure rotator (e.g., a pressure roller) is pressed against a nip former (e.g., a fixing roller), serving as one of the plurality of stretchers, via the fixing belt to form a fixing nip between the fixing belt and the pressure rotator while the pressure rotator rotates. As a recording medium bearing a toner image is conveyed through the fixing nip, the fixing belt and the pressure rotator fix the toner image on the recording medium.

A separation mechanism separates the recording medium having passed through the fixing nip from the fixing belt. For example, the separation mechanism includes a separation claw disposed downstream from the fixing nip in a recording medium conveyance direction. A front end of the separation claw is disposed opposite an outer circumferential surface of the fixing belt with a predetermined gap therebetween. A separator contacts an inner circumferential surface of the fixing belt to increase a curvature of an opposed portion of the fixing belt that is disposed opposite the separation claw. In other words, the separator decreases a radius of curvature of the opposed portion of the fixing belt. The separator is isolated from the pressure rotator via the fixing belt.

After the recording medium passes through the fixing nip, the recording medium may wave. While the waved recording medium is conveyed by the output roller pair 52 depicted in FIG. 1, streaked creases may be produced on the recording medium. The recording medium having passed through the fixing nip may wave while the recording medium moves from an exit of a nip including the fixing nip to a separation position where the separator separates the recording medium from the fixing belt. Waving of the recording medium may occur in the comparative fixing device due to reasons described below.

As an image side of a recording medium that bears an unfixed toner image is heated by the fixing belt under pressure while the recording medium is conveyed through the fixing nip, toner of the toner image is melted and fixed on the recording medium. After the recording medium is ejected from the fixing nip, the recording medium is conveyed to the separation position where the separator separates the recording medium from the fixing belt in a state in which the melted toner of the toner image on the recording medium adheres to the fixing belt. When the recording medium reaches the separation position, the separator separates the recording medium from the fixing belt. As the recording medium is heated by the fixing belt at the fixing nip, moisture contained in the recording medium is vaporized into steam. However, since the fixing belt and the pressure rotator sandwich the recording medium with substantial pressure at the fixing nip, steam is not discharged from the recording medium easily.

Conversely, while the recording medium is conveyed from the fixing nip to the separation position in the state in which the melted toner of the toner image on the recording medium adheres to the fixing belt, since the recording medium receives no pressure, steam generated at the fixing nip is discharged from the recording medium easily. Steam is mainly discharged from a back side of the recording medium that is disposed opposite the pressure rotator. A height of a non-image section on the recording medium that does not bear the toner image is smaller than a height of an image section on the recording medium that bears the toner image. Accordingly, a gap is produced between the fixing belt and the non-image section on the recording medium. Steam is discharged from the recording medium to the gap also. As the recording medium discharges steam, fiber of the recording medium dries. Accordingly, the recording medium shrinks and waves.

Steam discharged to the gap between the fixing belt and the non-image section on the recording medium remains in the gap. Steam is reabsorbed by the recording medium. As the recording medium reabsorbs steam discharged therefrom and moistens, fiber of the recording medium stretches. Accordingly, the recording medium waves.

While the recording medium moves from the fixing nip to the separation position, fiber of the recording medium suffers from contraction as the recording medium discharges steam and dries and expansion as the recording medium reabsorbs steam and moistens. Accordingly, the recording medium waves.

To address this circumstance, in the aspect 1 of the fixing device, the recording medium ejected from the fixing nip is conveyed to a separation position where a separator (e.g., the separation aid 48) separates the recording medium from the fixing belt in a state in which the presser presses the recording medium against the pressure rotator via the fixing belt. Even if the recording medium discharges steam while the recording medium moves to the separation position, the presser presses the fixing belt and the recording medium against the pressure rotator while the recording medium discharges steam. Although fiber of the recording medium is susceptible to shrink as the recording medium discharges steam, the presser presses the recording medium against the pressure rotator entirely, preventing fiber of the recording medium from shrinking. Consequently, even while the recording medium moves from the fixing nip to the separator, the presser prevents the recording medium from waving due to discharging of steam.

Even if the recording medium reabsorbs steam discharged therefrom while the recording medium moves from the fixing nip to the separation position, the presser presses the fixing belt and the recording medium against the pressure rotator while the recording medium reabsorbs steam. Although fiber of the recording medium is susceptible to stretch as the recording medium absorbs steam, the presser presses the recording medium against the pressure rotator entirely, preventing fiber of the recording medium from stretching. Accordingly, even while the recording medium moves from the fixing nip to the separation position, the presser prevents the recording medium from waving due to reabsorption of steam. Consequently, the presser prevents the recording medium from waving while the recording medium is conveyed to the separation position where the separator separates the recording medium from the fixing belt.

In the aspect 1 of the fixing device, the presser is movable between the contact position and the isolation position. Accordingly, when no recording medium is conveyed through the fixing device or when the recording medium conveyed toward the fixing nip is a type of a sheet that is not susceptible to waving such as thick paper, the presser is situated at the isolation position where the presser isolates the fixing belt from the pressure rotator. Thus, the presser reduces a load to be imposed by the presser to the fixing belt and the pressure rotator while the presser presses the fixing belt against the pressure rotator, extending the life of the fixing belt and the pressure rotator.

A description is provided of advantages of the fixing device in the aspect 2.

According to the aspect 1, a controller (e.g., the controller 200 depicted in FIG. 11) controls the mover, based on the type of the recording medium conveyed toward the fixing nip or the like, to move the presser to one of the contact position and the isolation position.

Accordingly, if the recording medium is a type of a sheet (e.g., an OHP transparency and thick paper) that is not susceptible to waving as the recording medium discharges and reabsorbs steam while the recording medium is conveyed to a separation position where the separator separates the recording medium from the fixing belt, the controller controls the mover to move the presser to the isolation position where the presser isolates the fixing belt from the pressure rotator. Consequently, the presser reduces the load imposed by the presser to the fixing belt and the pressure rotator, improving durability of the fixing belt and the pressure rotator. Additionally, the mover reduces friction between the presser and an inner circumferential surface of the fixing belt, suppressing abrasion of the inner circumferential surface of the fixing belt.

Conversely, if the recording medium is a type of a sheet that is susceptible to waving such as thin paper while the recording medium is conveyed to the separation position where the separator separates the recording medium from the fixing belt, the mover moves the presser to the contact position. Consequently, the mover prevents the recording medium from waving while the recording medium is conveyed to the separation position where the separator separates the recording medium from the fixing belt.

The controller controls the mover, based on the type of the recording medium conveyed toward the fixing nip or the like, to move the presser to one of the contact position and the isolation position. Thus, the controller suppresses waving of the recording medium and reduces the load imposed to the fixing belt and the pressure rotator.

A description is provided of advantages of the fixing device in the aspect 3.

According to the aspect 1 or 2, as illustrated in FIGS. 12, 16, and 19, when no recording medium is conveyed through the fixing device, the mover moves the presser to the isolation position where the presser isolates the fixing belt from the pressure rotator.

Accordingly, as described above in the exemplary embodiments, compared to a configuration in which the presser presses the fixing belt against the pressure rotator constantly, the presser reduces the load imposed by the presser to the fixing belt and the pressure rotator, improving durability of the fixing belt and the pressure rotator.

A description is provided of advantages of the fixing device in the aspect 4.

According to any one of the aspects 1 to 3, as illustrated in FIGS. 11, 17, and 21, the mover includes a cam (e.g., the cam 25). As the cam rotates, the mover moves the presser between the contact position and the isolation position. Thus, the mover moves the presser between the contact position and the isolation position with a simple construction.

A description is provided of advantages of the fixing device in the aspect 5.

According to any one of the aspects 1 to 4, as illustrated in FIG. 10, the nip former includes an elastic layer (e.g., the elastic layer 41*b*).

Accordingly, as described above with reference to FIG. 10, as the elastic layer of the nip former is deformed by pressure from the pressure rotator, at the exit of the fixing nip, an outer circumferential surface of the nip former is contoured to bulge to the inner circumferential surface of the fixing belt. Thus, the presser is situated in proximity to the exit of the fixing nip without contacting the outer circumferential surface of the nip former. Consequently, the presser decreases a border (e.g., the border N2*s*) where the presser or the like does not press the fixing belt against the pressure rotator, suppressing generation of steam at the border. Thus, the presser suppresses fixing failure such as variation in gloss of the toner image on the recording medium at a post nip (e.g., the post nip N2), where the presser presses the fixing belt against the pressure rotator, disposed downstream from the border in a recording medium conveyance direction (e.g., the sheet conveyance direction DP).

A description is provided of advantages of the fixing device in the aspect 6.

According to any one of the aspects 1 to 5, as illustrated in FIG. 5, the separator is disposed downstream from a downstream end (e.g., the downstream end 49*h*) of the presser the rotation direction of the fixing belt. The separator is isolated from the pressure rotator via the fixing belt. The fixing belt is looped over and stretched by the separator.

Accordingly, as described above in the exemplary embodiments, a curvature of the separator separates a soft recording medium such as thin paper and a recording medium bearing a toner image extending to a leading end of the recording medium, which are not separated from the fixing belt by a curvature of the fixing belt at an exit of the post nip formed between the fixing belt and the pressure rotator by the presser pressing the fixing belt against the pressure rotator. Since the separator is isolated from the pressure rotator via the fixing belt, the separator improves durability of the pressure rotator as described above in the exemplary embodiments.

A description is provided of advantages of the fixing device in the aspect 7.

According to any one of the aspects 1 to 6, the presser is a resilient plate.

Accordingly, as described above in the exemplary embodiments, compared to a configuration in which the presser is a block, the presser made of the resilient plate attains a reduced thermal capacity. Thus, the presser draws less heat from the fixing belt and thereby suppresses waste of heat. Accordingly, compared to the configuration in which the presser is the block, the presser made of the resilient plate shortens a waiting time for a user to wait until the fixing belt is heated to a target temperature. Additionally, compared to the configuration in which the presser is the block, the presser made of the resilient plate suppresses power consumption, saving energy.

Since the presser is resilient, the presser deforms readily to curve along an outer circumferential surface of the pressure rotator precisely, thus pressing the fixing belt against the pressure rotator precisely.

A description is provided of advantages of the fixing device in the aspect 8.

According to any one of the aspects 1 to 7, as illustrated in FIGS. 15 and 16, the mover pivots the presser about a rotation axis of the nip former on an arcuate trajectory along the outer circumferential surface of the nip former.

As described above as the first variation of the mover, when the presser is at the contact position, even if a front edge (e.g., the front edge 491) of the presser is disposed in proximity to the outer circumferential surface of the nip former, the front edge of the presser does not contact the outer circumferential surface of the nip former while the presser moves from the contact position depicted in FIG. 15 to the isolation position depicted in FIG. 16. Thus, the presser does not damage the outer circumferential surface of the nip former.

A description is provided of advantages of the fixing device in the aspect 9.

According to the aspect 8, as illustrated in FIG. 18, the mover includes a support (e.g., the support 300) that supports the presser and a driver (e.g., the driver 400) that drives the support. The support includes the guide 21, the coupler 22, the arm 23, and the support plate 24. The driver includes the cam 25, the driving shaft 25*a*, and the driving motor 85. The support includes a driving force receiver (e.g., the coupler 22) that receives a driving force from the driver. As illustrated in FIG. 19, the driving force receiver is disposed outside a loop formed by the fixing belt radially.

Accordingly, as described above as the first variation of the mover, even if the driving force receiver is shifted relative to the driver due to manufacturing error or assembly error, shifting of the driving force receiver exerts a reduced influence on the contact position and the isolation position of the presser.

A description is provided of advantages of the fixing device in the aspect 10.

According to any one of the aspects 1 to 9, the driver includes a driving portion (e.g., the cam 25) disposed outboard from a conveyance span in an axial direction of the fixing belt where the recording medium is conveyed over the fixing belt.

As described above with reference to FIGS. 17 to 19, since the driving portion is mounted on each lateral end of a single driving shaft (e.g., the driving shaft 25*a*) extending in the axial direction of the fixing belt, a single driving motor (e.g., the driving motor 85) drives a plurality of driving portions. Accordingly, compared to a configuration in which separate driving motors drive the plurality of driving portions, respectively, the fixing device in the aspect 10 reduces the number of the driving motors installed therein, reducing manufacturing costs.

A description is provided of advantages of the fixing device in the aspect 11.

According to any one of the aspects 1 to 10, as illustrated in FIG. 18, the mover includes a support (e.g., the support 300) that supports the presser and a driver (e.g., the driver 400) that drives the support. The support includes the guide 21, the coupler 22, the arm 23, and the support plate 24. The driver includes the cam 25, the driving shaft 25*a*, and the driving motor 85. The driving portion (e.g., the cam 25) of the driver is coupled to each lateral end of the support in the axial direction of the fixing belt.

Accordingly, as described above as the first variation of the mover, the driving portion coupled to each lateral end of the support in the axial direction of the fixing belt suppresses warping of the support compared to a configuration in which the driving portion is coupled to one lateral end of the support in the axial direction of the fixing belt such that the driving portion moves one lateral end of the support in the axial direction of the fixing belt.

A description is provided of advantages of the fixing device in the aspect 12.

According to any one of the aspects 1 to 11, as illustrated in FIG. 21, the mover further includes a positioner (e.g., the positioning roller 86) to position the presser at the contact position.

Thus, the presser presses the fixing belt against the pressure rotator with predetermined pressure. Accordingly, the presser suppresses waving of the recording medium precisely and reduces the load imposed on the fixing belt and the pressure rotator.

A description is provided of advantages of the fixing device in the aspect 13.

According to the aspect 12, as illustrated in FIG. 21, the positioner presses against the pressure rotator directly or indirectly via the fixing belt to position the presser at the contact position. The positioner includes a positioning roller (e.g., the positioning roller 86) that is rotatable.

Accordingly, as described above as the second variation of the mover, the positioning roller slides over the inner circumferential surface of the fixing belt that contacts the positioning roller with a reduced resistance, that is, a reduced friction, thus suppressing abrasion of the fixing belt contacting the positioning roller.

A description is provided of advantages of the fixing device in the aspect 14.

According to the aspect 12 or 13, as illustrated in FIG. 21, the mover includes the support that supports the presser and the driver that drives the support. The support includes the guide 21, the coupler 22, the arm 23, and the support plate 24. The driver includes the cam 25, the driving shaft 25*a*, the driving motor 85, and a joint (e.g., the joint 83). When the presser is situated at the contact position, the driver is isolated from the support.

Accordingly, as described above as the second variation of the mover, even if the joint, the driving portion, and the driving force receiver shift from a proper position due to slight manufacturing error or slight assembly error, the positioning roller presses against the pressure rotator precisely, thus positioning the presser at the contact position properly.

A description is provided of advantages of an image forming apparatus incorporating the fixing device in the aspect 15.

As illustrated in FIG. 1, an image forming apparatus (e.g., the image forming apparatus 1000) includes an image forming device (e.g., the image forming units 2Y, 2M, 2C, and 2K) that forms a toner image. The image forming device includes a latent image bearer (e.g., the photoconductors 3Y, 3M, 3C, and 3K), a charger (e.g., the charger 5Y), an optical writing unit (e.g., the optical writing units 1YM and 1CK), and a developing device (e.g., the developing device 4Y). The image forming apparatus further includes a transfer device (e.g., the primary transfer unit 60 and the secondary transfer unit 78) to transfer the toner image formed on the latent image bearer onto a recording medium (e.g., a sheet P). The image forming apparatus further includes a fixing device (e.g., the fixing devices 40, 40S, 40T, 40A, and 40B) according to any one of the aspects 1 to 14 to fix the toner image on the recording medium.

Accordingly, the fixing device and the image forming apparatus suppress waving of the recording medium while suppressing degradation in durability of the fixing device and prevent streaked creases from being produced on the recording medium after the recording medium passes through the fixing nip.

According to the exemplary embodiments described above, the fixing belt 43 serves as a fixing belt. Alternatively, a fixing film, a fixing sleeve, or the like may be used as a fixing belt. Further, the pressure roller 45 serves as a pressure rotator. Alternatively, a pressure belt or the like may be used as a pressure rotator.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present invention.

Any one of the above-described operations may be performed in various other ways, for example, in an order different from the one described above.

What is claimed is:

1. A fixing device comprising:

a fixing belt that is endless and rotatable in a rotation direction;

a nip former stretching the fixing belt;

a pressure rotator to press against the nip former via the fixing belt to form a fixing nip between the fixing belt and the pressure rotator, the fixing nip through which a recording medium is conveyed;

a presser, disposed downstream from an exit of the fixing nip in the rotation direction of the fixing belt, to bring the fixing belt into contact with the pressure rotator; and a mover, coupled to the presser, to move the presser between a contact position where the presser brings the fixing belt into contact with the pressure rotator and an isolation position where the presser isolates the fixing belt from the pressure rotator.

2. The fixing device according to claim 1, further comprising a controller to control the mover, based on a type of the recording medium conveyed toward the fixing nip, to move the presser to one of the contact position and the isolation position.

3. The fixing device according to claim 1,
wherein the mover moves the presser to the isolation position when no recording medium is conveyed through the fixing device.

4. The fixing device according to claim 1,
wherein the nip former includes an elastic layer.

5. The fixing device according to claim 1, further comprising a separator disposed downstream from a downstream end of the presser in the rotation direction of the fixing belt and isolated from the pressure rotator via the fixing belt, the separator stretching the fixing belt.

6. The fixing device according to claim 1,
wherein the presser includes a resilient plate.

7. The fixing device according to claim 1,
wherein the mover pivots the presser about a rotation axis of the nip former on an arcuate trajectory along an outer circumferential surface of the nip former.

8. The fixing device according to claim 1,
wherein the mover includes:
a support supporting the presser; and
a driver to drive the support.

9. The fixing device according to claim 8,
wherein the driver is isolated from the support when the presser is situated at the contact position.

10. The fixing device according to claim 8,
wherein the driver includes a driving portion to rotate to move the presser between the contact position and the isolation position.

11. The fixing device according to claim 10,
wherein the driving portion includes a cam.

12. The fixing device according to claim 10,
wherein the driving portion is disposed outboard from a conveyance span in an axial direction of the fixing belt where the recording medium is conveyed over the fixing belt.

13. The fixing device according to claim 10,
wherein the driving portion is coupled to each lateral end of the support in an axial direction of the fixing belt.

14. The fixing device according to claim 13,
wherein the driver further includes:
a driving shaft mounting the driving portion at each lateral end of the driving shaft in an axial direction of the driving shaft; and
a driving motor, coupled to one lateral end of the driving shaft in the axial direction of the driving shaft, to the drive and rotate the driving shaft.

15. The fixing device according to claim 8,
wherein the support includes a driving force receiver to receive a driving force from the driver, the driving force receiver being disposed outside a loop formed by the fixing belt.

16. The fixing device according to claim 15,
wherein the mover further includes a joint contacting the driver and separably contacting the driving force receiver.

17. The fixing device according to claim 1,
wherein the mover includes a positioner to position the presser at the contact position.

18. The fixing device according to claim 17,
wherein the positioner presses against the pressure rotator via the fixing belt to position the presser at the contact position.

19. The fixing device according to claim 18,
wherein the positioner includes a positioning roller that is rotatable.

20. An image forming apparatus comprising:
an image forming device to form a toner image; and
a fixing device disposed downstream from the image forming device in a recording medium conveyance direction to fix the toner image on a recording medium,
the fixing device including:
a fixing belt that is endless and rotatable in a rotation direction;
a nip former stretching the fixing belt;
a pressure rotator to press against the nip former via the fixing belt to form a fixing nip between the fixing belt and the pressure rotator, the fixing nip through which the recording medium is conveyed;
a presser, disposed downstream from an exit of the fixing nip in the rotation direction of the fixing belt, to bring the fixing belt into contact with the pressure rotator; and
a mover, coupled to the presser, to move the presser between a contact position where the presser brings the fixing belt into contact with the pressure rotator and an isolation position where the presser isolates the fixing belt from the pressure rotator.

* * * * *